US006332669B1

(12) United States Patent
Kato et al.

(10) Patent No.: US 6,332,669 B1
(45) Date of Patent: Dec. 25, 2001

(54) INK JET HEAD INCLUDING VIBRATION PLATE AND ELECTRODE SUBSTRATE

(75) Inventors: Seiichi Kato; Kouichi Ohtaka, both of Miyagi; Hiromichi Komai, Kanagawa; Junichi Azumi, Miyagi, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/092,655

(22) Filed: Jun. 5, 1998

(30) Foreign Application Priority Data

| | | |
|---|---|---|
| Jun. 5, 1997 | (JP) | 9-148062 |
| Dec. 16, 1997 | (JP) | 9-364174 |
| Feb. 19, 1998 | (JP) | 10-028846 |
| Mar. 12, 1998 | (JP) | 10-061308 |
| Apr. 24, 1998 | (JP) | 10-115130 |

(51) Int. Cl.[7] ..... B41J 2/04
(52) U.S. Cl. ..... 347/54
(58) Field of Search ..... 347/54, 68, 69, 347/70, 71, 72, 50, 40; 399/261, 361, 700; 29/890.1; 310/328–330

(56) References Cited

U.S. PATENT DOCUMENTS

| | | | | |
|---|---|---|---|---|
| 5,038,159 | * | 8/1991 | Schmidlin et al. | 347/55 |
| 5,221,934 | * | 6/1993 | Long | 347/55 |
| 5,815,178 | * | 9/1998 | Silverbrook | 347/55 |
| 6,003,975 | * | 12/1999 | Desie | 347/55 |

FOREIGN PATENT DOCUMENTS

| | | |
|---|---|---|
| 5-50601 | 3/1993 | (JP) . |
| 5169660 | 7/1993 | (JP) . |
| 6-23980 | 2/1994 | (JP) . |
| 6-71882 | 3/1994 | (JP) . |
| 7125196 | 5/1995 | (JP) . |

* cited by examiner

*Primary Examiner*—Benjamin R. Fuller
*Assistant Examiner*—C Dickens
(74) *Attorney, Agent, or Firm*—Cooper & Dunham LLP

(57) ABSTRACT

An ink jet head of the present invention compresses ink with an electrostatic force generated between each vibration plate and a counter electrode facing it. A glass substrate is formed with through holes in which a conductor is buried. A metal wiring pattern and conductor bumps are provided on the rear of each counter electrode. The conductor bumps and counter electrodes associated therewith are electrically connected together. Ink is fed from the rear of the glass substrate to a common ink chamber via a through hole assigned to ink feed. A metal wiring pattern on the rear of the glass substrate allows the conductor bumps to be arranged at any desired positions. The head does not need any flexible printed circuit board or any wiring substrate.

34 Claims, 25 Drawing Sheets

INK JET HEAD INCLUDING VIBRATION PLATE AND ELECTRODE SUBSTRATE

BACKGROUND OF THE INVENTION

The present invention relates to a printer, facsimile apparatus, copier or similar ink jet recording apparatus and, more particularly, to an ink jet head for use in an ink jet recording apparatus.

An on-demand type ink jet printer belonging to a family of ink jet recording apparatuses is extensively used because of low cost and relatively high image quality achievable therewith. Various implementations have heretofore been proposed to provide an ink jet head included in such a printer with a compact configuration.

Japanese Patent Laid-Open Publication No. 5-169660, for example, teaches an ink jet head including an actuator portion for transferring energy to ink in a compression chamber, The actuator portion is connected to a drive circuit board, which drives the actuator portion, by flexible wiring, so that a drive portion can be located at the opposite side to the actuator portion Japanese Patent Laid-Open Publication No. 5-50601 proposes an edge type ink jet head and a face type ink jet head each ejecting ink with an electrostatic force. These ink jet heads each has a laminate structure made up of three substrates, i.e., an upper substrate, an intermediate substrate, and a lower substrate. The intermediate substrate is an Si (silicon) substrate formed with nozzle grooves, recesses whose bottoms constitute vibration plates, fine grooves for incoming ink, and recesses constituting ink cavities by photolithography. The upper substrate is formed of glass or plastic and bonded to the intermediate substrate so as to define nozzles, ejection chambers, orifices, and ink cavities. The lower substrate is formed of glass and bonded to the intermediate substrate by anodic bonding so as to form vibration chambers and electrodes respectively corresponding to the vibration plates. A voltage is applied between Si of the intermediate substrate and any one of the electrodes of the lower substrate in order to cause the vibration plate to deform due to an electrostatic force. When the electrostatic force is cancelled, the vibration plate returns to its original position. The resulting increase in pressure inside the ejection chamber causes the ink to be ejected from the nozzle.

Japanese Patent Laid-Open Publication No. 6-71882 proposes a method of reducing a potential difference between the vibration plates and the electrodes at the time of the anodic bonding of the intermediate substrate and lover substrate. The method consists in equalizing the potential of the vibration plates and that of the electrodes by use of a jig. With this method, it is possible to obviate the deformation of the vibration plates ascribable to the above potential difference.

Japanese Patent Laid-Open Publication Nos. 7-125196 and 6-23980 also disclose technologies relating to an ink jet head.

The structure taught in Laid-Open Publication No. 5-169660, however, has some problems left unsolved, as follows. The ejection portion for transferring energy to ink and a drive portion are connected by a flexible printed circuit board (FPC hereinafter), wire bonding, or soldering. This limits the radius of curvature available with the FPC or circuit board for energy transfer and therefore needs a thick support member. Because the electrodes are led out to the rear of the support member, wire bonding, wiring board or soldering is necessary which increase the mounting time and cost. In addition, while Si and a glass substrate are generally bonded together by anodic bonding, it is necessary with a structure of the kind leading out electrodes from the side to dice each piece and then effect anodic bonding or to remove a part of an Si substrate after the anodic bonding of an Si wafer and a glass wafer. Such a procedure is extremely complicated.

The structures-taught in Laid-Open Publication Nos. 5-50601 and 6-71882 each includes terminals for voltage application led out from the surface of the lower substrate by bonding. The precondition with this configuration is that the intermediate and lower substrates be different in dimension. To produce inexpensive heads on a quantity basis, it is necessary that a medium Si substrate and an upper and a lower glass substrate be processed and assembled in a wafer size and then cut into heads In this respect, the above conventional structure is disadvantageous in that steps between the intermediate and lower substrates reduces the number of heads for a single intermediate substrate wafer and thereby increases the cost, and in that a special cutting technique as well as a greater number of times of cutting is necessary. Further, it is almost impossible to equalize the potential of the vibration plates and that of the electrodes with the above implementation when it comes to the wafer size.

Moreover, for color recording, a plurality of heads respectively assigned to different colors of ink must be arranged side by side. Particularly, with the face type head, it is necessary to connect the front of the lower electrodes to the drive circuit by use of, e.g., an FPC. This, however, brings about a problem that because the lower substrate is greater in dimension than the intermediate substrate and because particular portions must be assigned to, eg., an FPC, the overall dimensions of a plurality of heads increase. Another problem is that the limited radius of curvature of the FPC obstructs reliable bonding of the electrodes and FPC. While the nozzles are often arranged in a zigzag configuration in order to increase recording density, such a configuration needs, e.g., two FPCs respectively assigned to two nozzle arrays. As a result, the number of assembling steps and cost are increased.

The structure disclosed in Laid-Open Publication No. 7-125196 has a drawback that the independent electrodes and vibration plates must each be mounted by an exclusive step. Further, electrodes must be led from the independent electrode and vibration plate to the respective mounting regions This, coupled with the fact that the regions assigned to the independent electrodes must extend outward over the regions assigned to the electrodes of the vibration plates, increases the overall size of the substrate.

With the edge type head taught in Laid-Open Publication No. 6-23980 it is difficult to implement multidimensional arrays for mounting reasons. With the face type head, it is easier to implement multidimensional arrays than with the edge type bead; a multistage zigzag arrangement, for example, will increases dot density and therefore resolution. However, even the dot density available with the multistage zigzag arrangement is limited when it is desired to position the mounting surface in the same plane as the nozzles, due to the limited mounting technologies.

SUMMARY OF THE INVENTION

It is therefore an object of the present invention to provide an ink jet head eliminating the need for. e.g., FPCs and thereby saving a space otherwise occupied by a support member for a circuit board, allowing bumps to be connected to a drive circuit to be formed at any desired positions, and facilitating design as to the positioning of the head relative to a printed circuit board including the drive circuit.

It is another object of the present invention to provide an ink jet head easy to process and assemble at a wafer level, low cost, and capable of reducing the overall size when a plurality of heads are arranged together.

It is still another object of the present invention to provide an ink jet head capable of reducing a substrate size, simplifying a mounting procedure, reducing cost, forming through holes or bores with accuracy, insuring reliable conduction, and allowing counter electrodes to be densely arranged.

It is a further object of the present invention to provide an ink jet head implementing a device configuration adaptive to an increase in dot density (nozzle density) which may be desired to enhance resolution.

An ink jet head of the present invention includes a vibration plate substrate including thin vibration plates, and an electrode plate spaced from the vibration plate substrate by a small gap and carrying counter electrodes respectively facing the vibration plates on the front thereof. When a voltage is applied between the vibration plate substrate and the electrode substrate, the resulting electrostatic force acting between any one of the vibration plates and associated counter electrode causes ink to be ejected due to the mechanical movement of the vibration plate. The counter electrodes on the front of the electrode substrate are led out to the rear of the electrode substrate.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1A:
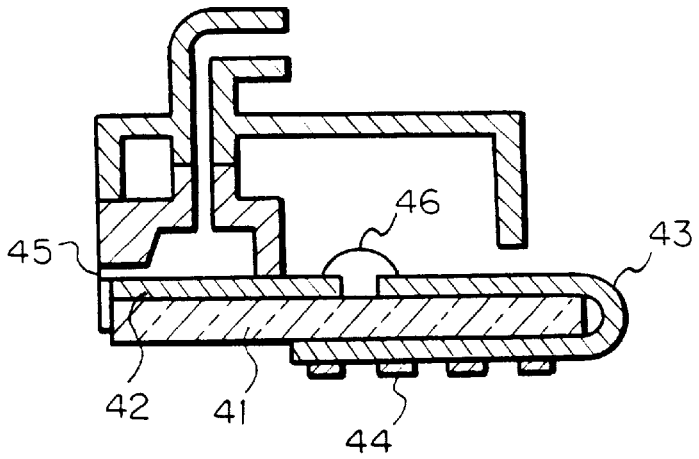
Fig. 1A PRIOR ART
FIGS. 1A and 1B are fragmentary sections showing a conventional ink jet head.
Figure 1B:
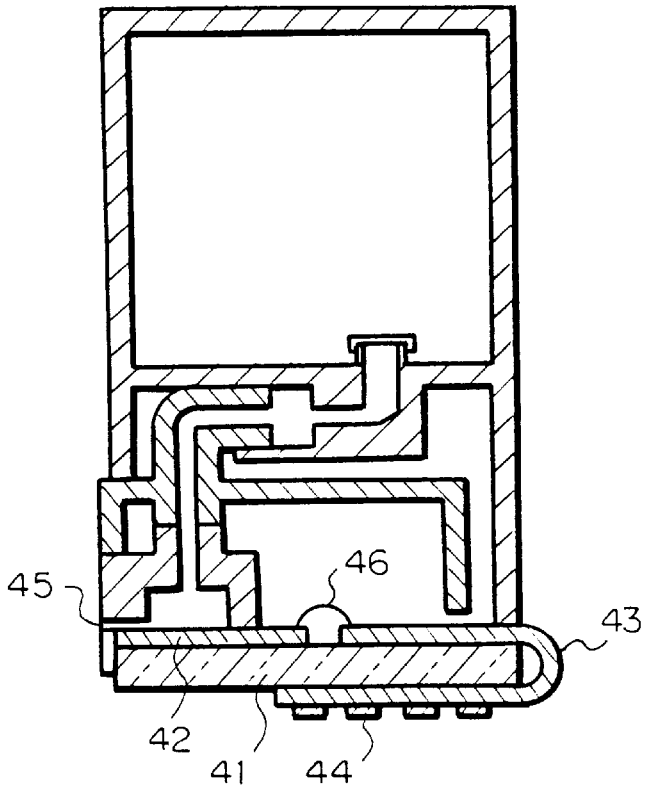
Fig. 1B PRIOR ART

To better understand the present invention, brief reference will be made to a conventional ink jet head taught in Laid-Open Publication No. 5-169660 mentioned earlier. FIG. 1A shows an essential part of the ink jet head while FIG. 1B shows an assembly including the head. There are shown in FIGS. 1A and 1B a support member 41, a heater board or energy substrate 42, an FPC 43, contact pads or connection terminals 44, an ejection port 45, and wire bonding 46.

The heater board 42 is mounted on the support member 41 and plays the role of energy generating means for causing ink to be ejected via the ejection port 45. The FPC 43 extends along the support member 41 to the side opposite to the side where the heater board 41 is positioned The contact pads 44 are also positioned at the side opposite to the side where the heater board 41 is positioned, so that a record signal received from an apparatus body can be transferred to the heater board 42 via the pads 44. This configuration promotes the efficient use of both sides of the support 41 and allows the area of the support 41 to be reduced to thereby further miniaturize the head. However, such a configuration has the various problems discussed earlier.

Figure 2A:
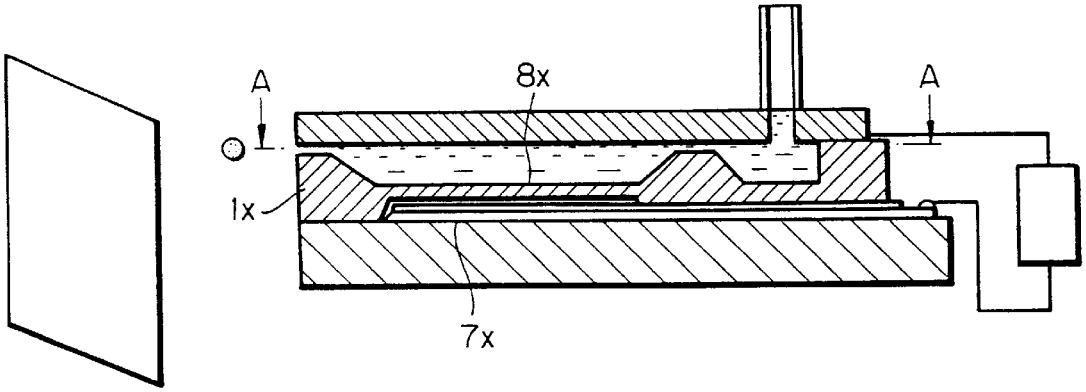
Fig. 2A PRIOR ART
FIGS. 2A and 2B are fragmentary sections showing another conventional ink jet head.
Figure 2B:
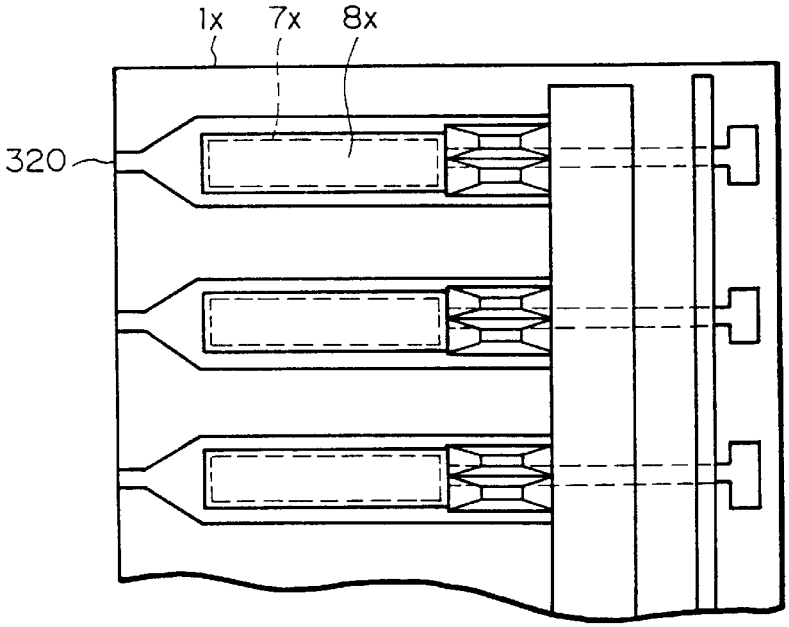
Fig. 2B PRIOR ART

FIGS. 2A and 2B show an ink jet head disclosed in Laid-Open Publication No. 7-125196 also mentioned earlier. As shown, the head includes a substrate 1*x* implemented as a molding including vibration electrodes 8*x*. Electrodes 7*x* respectively face the vibration electrodes 8*x* and are spaced from the electrodes 8*x* by gaps. The electrodes 7*x* and vibration electrodes 8*x* are respectively led out to common planes, so that a voltage can be selectively applied thereto. However, the electrodes 7*x* and 8*x* in such a configuration brings about the previously stated problems.

Figure 3A:
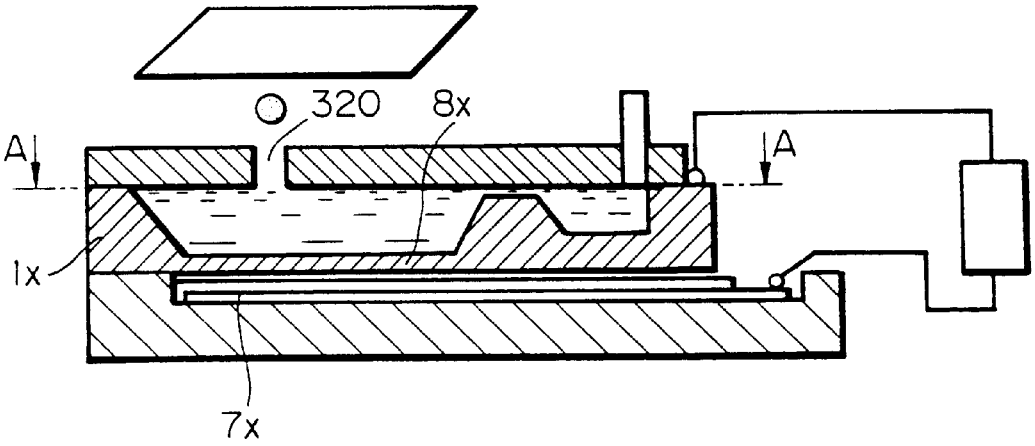
Fig. 3A PRIOR ART
FIGS. 3A and 3B show still another conventional ink jet head.
Figure 3B:
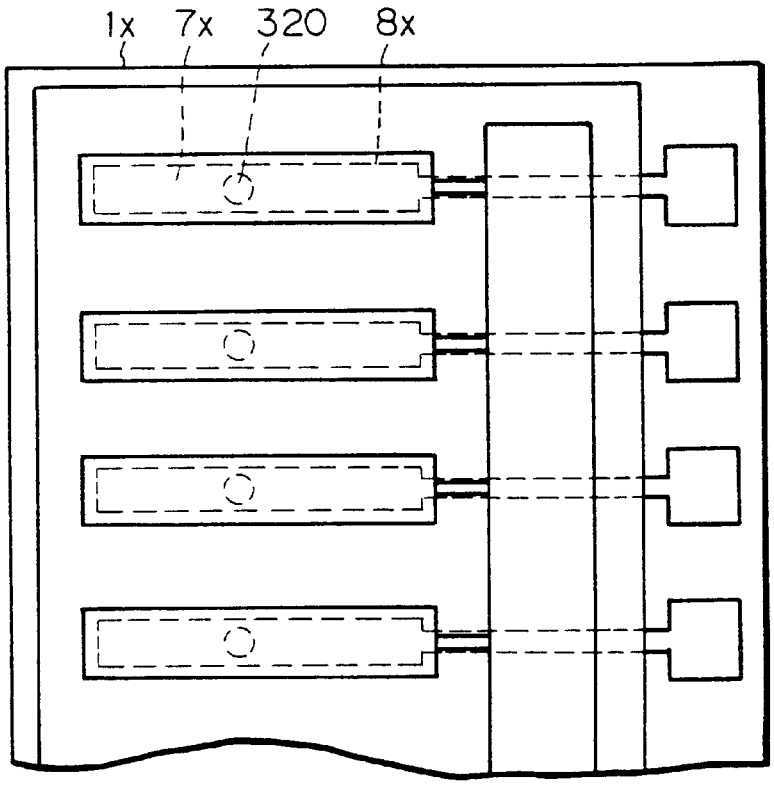
Fig. 3B PRIOR ART
Figure 3C:
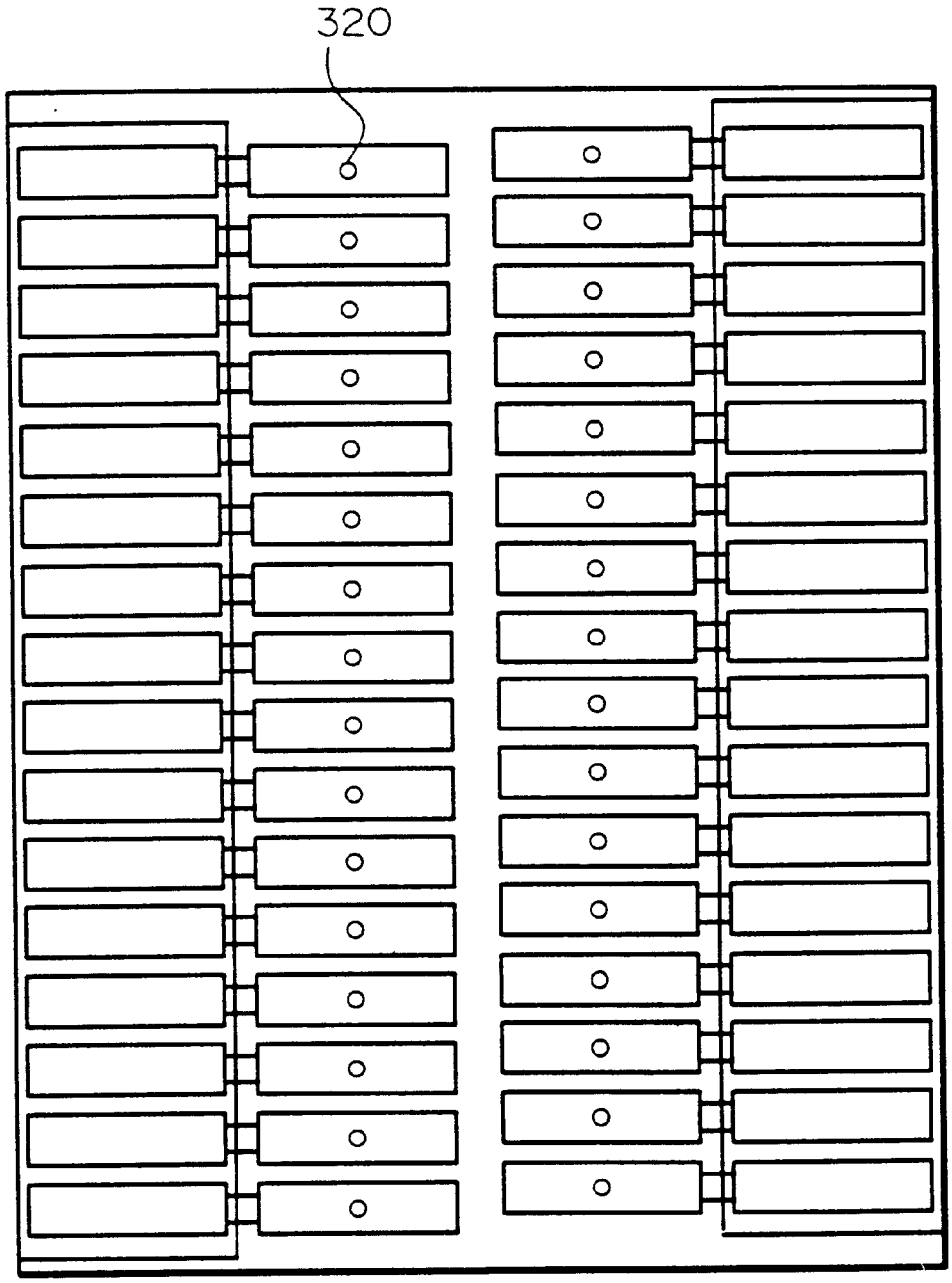
Fig. 3C PRIOR ART
FIG. 3C shows a specific one-dimensional array available with the head shown in FIGS. 3A and 3B.

FIGS. 3A–3C show an ink jet head proposed in Laid-Open Publication No. 6-23980 also mentioned earlier. FIG. 3A shows an edge type ink jet head capable of ejecting ink toward the same plane as the general plane of a chip FIG. 3B shows a specific one-dimensional array configuration. FIG. 3C shows a face type ink jet head having a one-dimensional array and so constructed as to eject ink perpendicularly to the general plane of a chip. Each of these heads, like the head shown in FIGS. 2A and 2B, includes the substrate 1*x* including the vibration electrodes 8*x* and electrodes respectively facing the vibration electrodes 8*x*. The electrodes 7*x* and vibration electrodes 8*x* are respectively led out to common planes, so that a voltage can be selectively applied thereto The problem with the edge type head is that it cannot be easily implemented as multidimensional arrays for mounting reasons. With the face type head, it is easier to implement multidimensional arrays than with the edge type head. For example, if the configuration shown in FIGS. 3A and 3B is arranged in two zigzag arrays, as shown in FIG. 3C, and driven in a particular manner, then dot density can be doubled so as to realize high resolution. However, the face type head has a drawback that even the dot density available with the zigzag arrays is limited for mounting reasons when a mounting surface is to be provided in the same plane as nozzles, as discussed earlier.

Referring to FIGS. 4A–4F, a first embodiment of the ink jet head in accordance with the present invention will be described. FIGS. 4A–4F show a sequence of steps for producing the head. There are shown in FIGS. 4A–4F a glass (electrode) substrate 1, a groove 2 for defining a gap, a through hole 3 in which a conductor 5 is buried, organic resist 4*a*, 4*a* and 4*b*, a conductor 6 in the form of a bump (bump conductor hereinafter), a counter electrode 7, a silicon substrate 8, a vibration plate 8*v*, a metal plate (nozzle plate) 9, an ink inlet port 10, a common ink chamber 11, and an ink feed passageway 12.

Figure 4A:
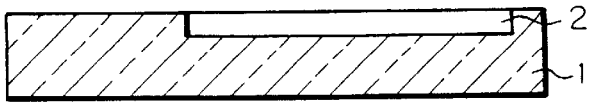
FIGS. 4A–4F are fragmentary sections showing a first embodiment of the ink jet head in accordance with the present invention.
Figure 4B:
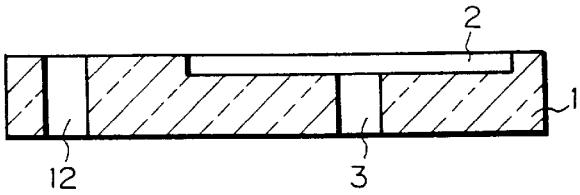

As shown in FIG. 4A, organic resist, not shown, is patterned on the glass substrate 1 by photolithography, and then the groove 2 is formed to a depth of 1 $\mu$m by etching using buffered hydrofluoric acid. A metal film will be formed on the bottom of the groove 2 in order to form the counter electrode 7 later. As shown in FIG. 4B, the holes 3 and 12 are formed from the rear to the front of the glass substrate 1 by use of a $CO_2$ laser; the hole 3 is communicated to the groove 2. Optics is so set as to provide a beam to issue from the laser with a diameter of smaller than 30 $\mu$m, as measured at the groove 2. In addition, pulses are provided with a variable duty ratio in order to prevent the substrate 1 from cracking or deforming due to heat.

The $CO_2$ laser used to form the holes 3 and 12 may be replaced with any other suitable implementation. For example, there may be executed a sequence of steps of forming an Ni (nickle), a Cr (chromium) or an Ni—Cr film on the rear of the substrate 1 by plating, pattering the desired regions by use of photoresist, and etching the above film with an etchant suitable for the film to thereby form a metal mask. Alternatively, the holes 3 and 12 may be formed by RIE (Reactive Ion Etching) using a CHF3, CF4, SF6 and Ar gas mixture.

Figure 4C:
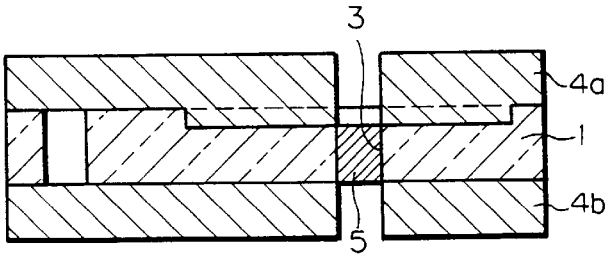
Figure 4D:
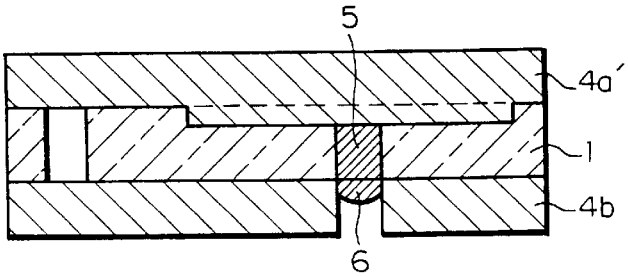
Figure 4E:
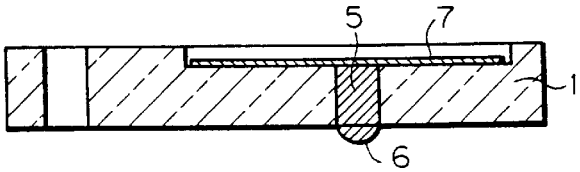

As shown in FIG. 4C, both sides of the glass substrate 1, except for the hole 3, are covered with the organic resist 4*a* and 4*b* by photolithography. After Cr sputtering, Au (gold) electroless plating using, e.g., a sulfurous acid-gold bath is effected in order to bury Au in the hole 3. As a result, the conductor 5 is formed in the hole 3. If desired, Au used for the electroless plating may be replaced with Ni. As shown in FIG. 4D, the organic resist 4*a*' is caused to cover the surface of the substrate 1 where the groove 2 is present. Then, the bump conductor 6 is formed by Au plating. Subsequently, a resist pattern, not shown, representative of desired electrodes is formed by photolithography on the surface of the substrate 1 where the groove 2 is present. After a Ti film and a Pt film have been formed by sputtering, the counter electrode 7 is formed by lift-off, as shown in FIG. 4E.

Figure 4F:
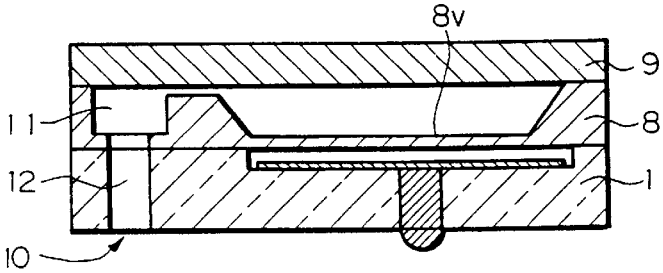

The Si substrate 8 with the vibration plate 8*v* is formed by a procedure to be described hereinafter with reference to FIG. 4F. First, a 200 $\mu$m thick (100) Si wafer is prepared. After a 2 $\mu$m thick thermally oxidized film has been formed on the wafer, resist is patterned by photolithography. Then, desired regions are opened by etching using buffered hydrofluoric acid. This is followed by anisotropic etching effected at 80° C. by use of a 47% KOH (potassium hydrooxide) aqueous solution. At this instant, the amount of etching is controlled in terms of, e.g., etching time in order to form the vibration plate 8*v* which is about 10 $\mu$m thick. The ink feed hole 12 is used to feed ink from the rear of the glass substrate 1 to the common liquid chamber 11. While a hole must be formed in the Si substrate 8 in alignment with the hole 123, it can be easily formed only if the amount of etching is increased there. The Si substrate 8 including the vibration plate 8*v* is anodically bonded to the side of the glass substrate 1 where the groove 2 is present, in alignment with the counter electrode 7. For anodic bonding, the glass substrate 1 and Si substrate 8 may be evenly heated to 400° C. in a vacuum atmosphere, and then 900 V may be applied; the glass substrate 1 is provided with positive polarity. Finally, the metal plate 9 formed with nozzle holes by Ni plating electroforming is adhered to the ink chamber portion of the Si substrate 8 by epoxy adhesive.

Figure 5A:
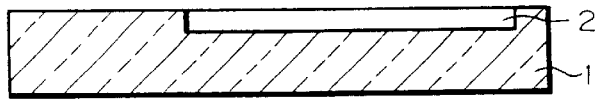
FIGS. 5A–5F are fragmentary sections showing a second embodiment of the present invention.
Figure 5B:
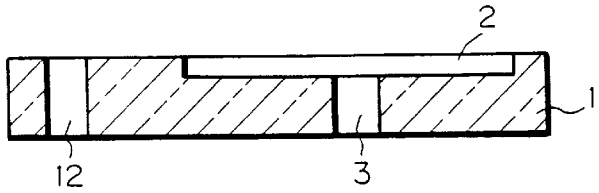
Figure 5C:
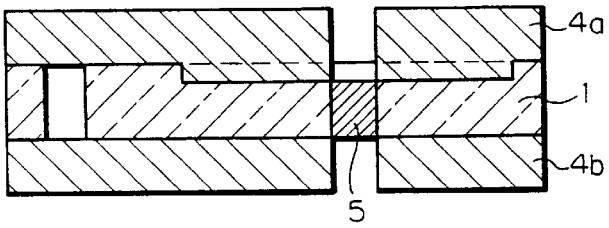
Figure 5D:
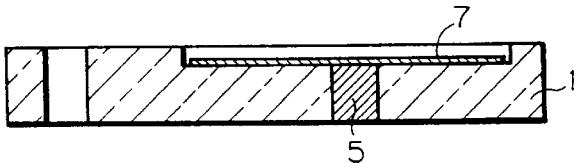
Figure 5E:
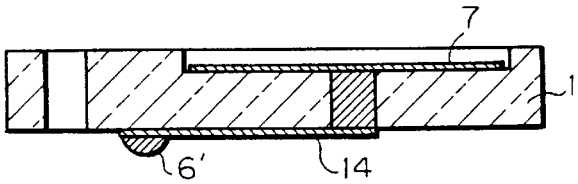
Figure 5F:
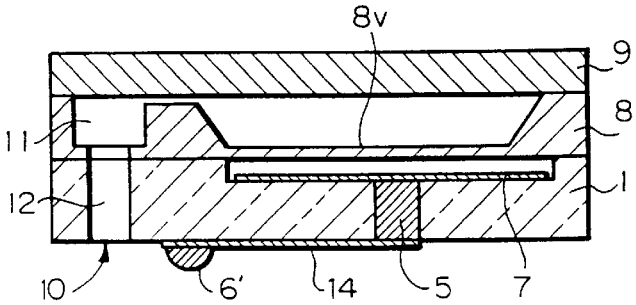
Figure 6:
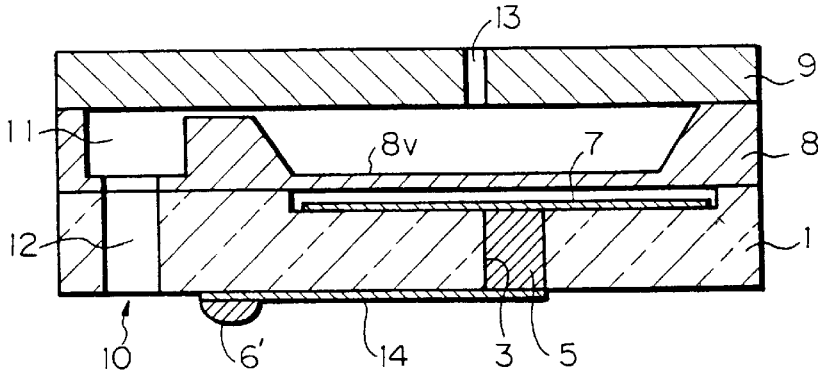
FIG. 6 is a fragmentary section of the second embodiment.

Reference will be made to FIGS. 5A–5F and 6 for describing a second embodiment of the ink jet head in accordance with the present invention. FIGS. 5A–5B demonstrate a procedure for producing the head; designated by the reference numeral 14 is a metal wiring pattern. FIG. 6 is a fragmentary section of the head produced by the above procedure; designated by the reference numeral 13 is a nozzle.

The second embodiment differs from the first embodiment in that it does not effect the additional plating in the event of burying the conductor in the hole 3, and does not form the conductor bump 6 beneath the hole 3. The second embodiment causes the Si substrate 8 and nozzle plate 9 to form the ink chamber in exactly the same manner as the first embodiment. That is, the steps shown in FIGS. 5A–5D are effected in the same manner as in the first embodiment. When a wiring from the counter electrode 7 is led out to the rear of the glass substrate 1 via the hole 3, the mew wiring pattern 14 is formed on the rear of the substrate 1. A conductor bump 6' is formed on the pattern 14 at a position suitable for the connection of the pattern 14 to a device.

Specifically, as shown in FIG. 5E, an organic resist pattern, not shown, is formed by photolithography. After a Ti (titanium) film has been formed by photolithography, a Pt (platinum) film or an Au film is formed by sputtering, and then the metal wiring pattern 14 is formed by lift-off. Subsequently, organic resist, not shown, is patterned by photolithography, and then the conductor bump 6' is formed by Au electroless plating using, e.g., a sulfurous acid-gold bath. The conductor bump 6' can therefore be positioned in matching relation to a preselected part of a device. Finally, after the anodic bonding of the Si substrate 8, the metal plate 9 formed with nozzle holes by, e.g., Ni plating electroforming is adhered to the Si substrate 8 by epoxy adhesive, as shown in FIG. 5F.

The first and second embodiment described above promote easy mounting of an electrostatic ink jet head without resorting to, e.g., any FPC and thereby reduces the mounting cost. Further, it is not necessary to provide the wafer with regions otherwise assigned to leads and pads, so that the number of devices available with a single wafer can be increased. For example, assume that a 100 mm wafer is used, that a chip size is 5 mm×15 mm, that 100 μm long bonding pads are arrayed in two arrays, and that seventy-five chips are produced from a single wafer. Then, there can be saved an area of 0.1 mm×15×2×75=223 $mm^2$. This means that three additional chips are available with a single wafer.

Figure 7:
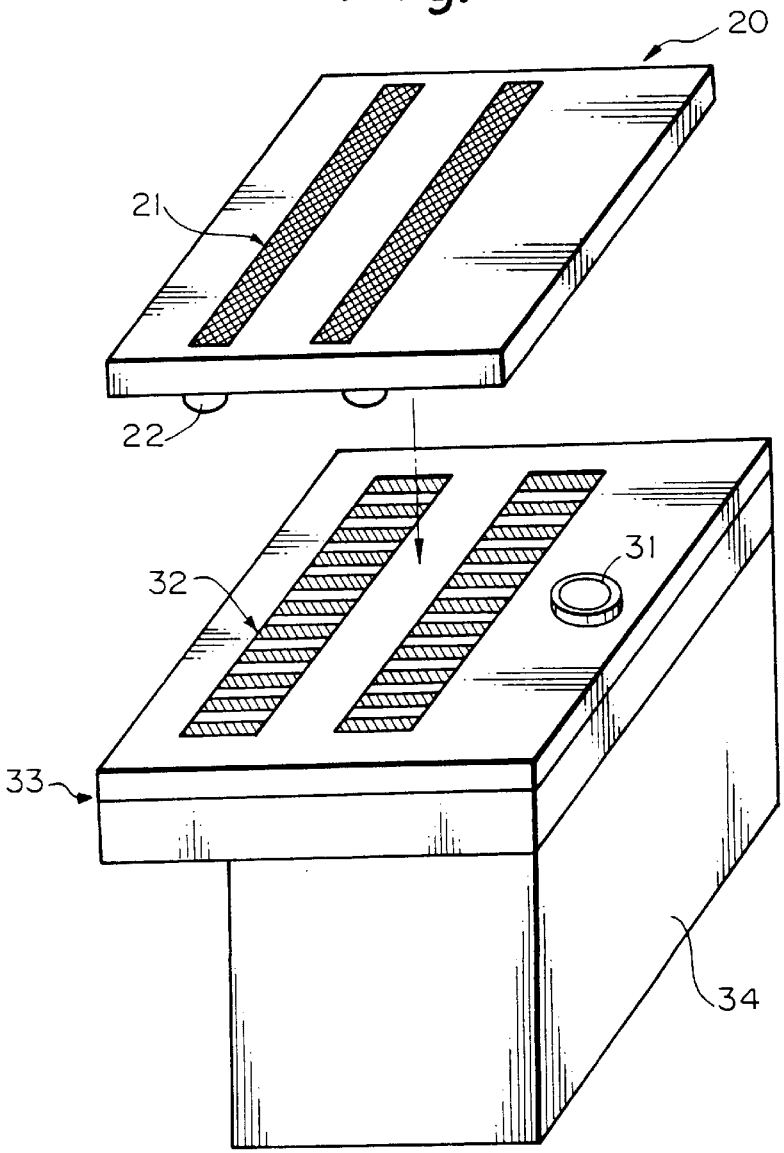
FIG. 7 is a perspective view showing an ink jet head available with any one of the above embodiments.

FIG. 7 shows the general construction of an ink jet head unit implemented by either one of the first and second embodiments. There are shown in FIG. 7 an ink jet head portion 20, nozzle arrays 21, pump arrays 22 included in the head portion 20, an ink inlet port 31, bump arrays 32 adjoining an ink chamber 34, and a substrate 33 assigned to a drive circuit. The ink jet head portion 20 with the nozzles 21 has its bumps 22 connected to the bumps 32 formed on the substrate 33 above the ink chamber 34. The head unit can therefore be produced without resorting to any FPC or wire bonding.

Figure 8A:
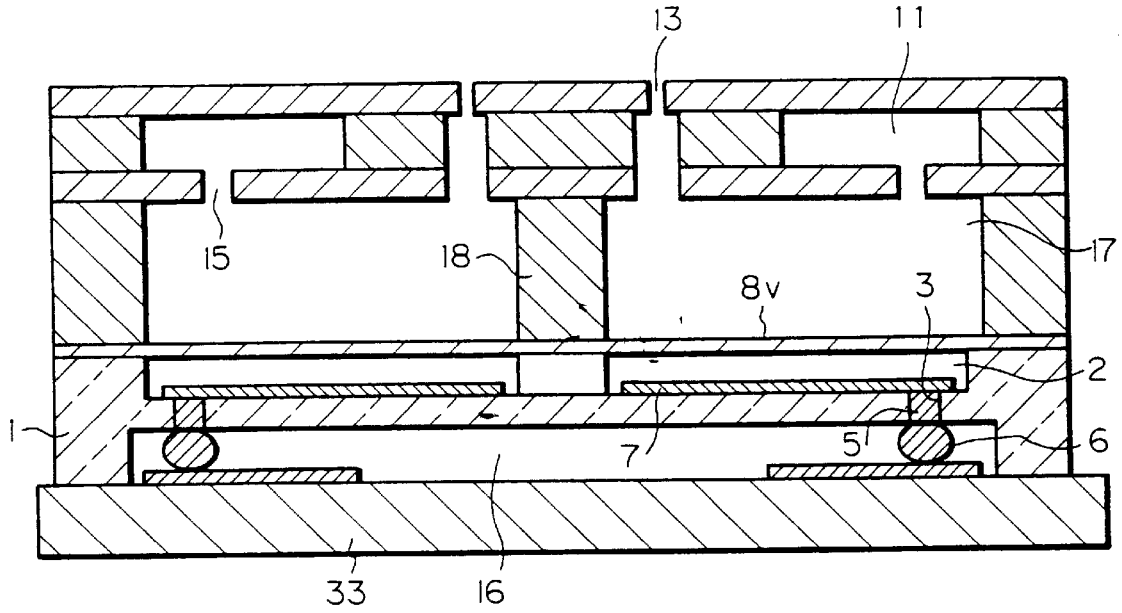
FIGS. 8A and 8B are fragmentary sections showing a third embodiment of the present invention.
Figure 8B:
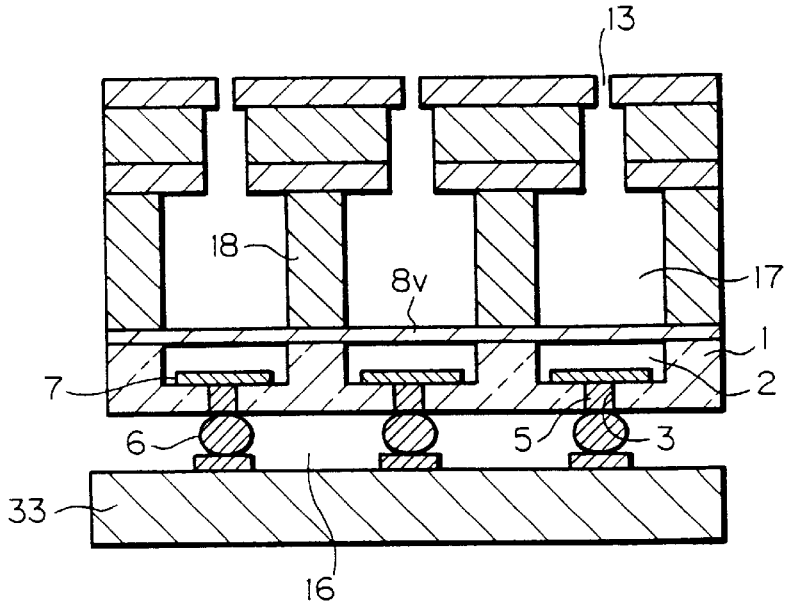
Figure 9A:
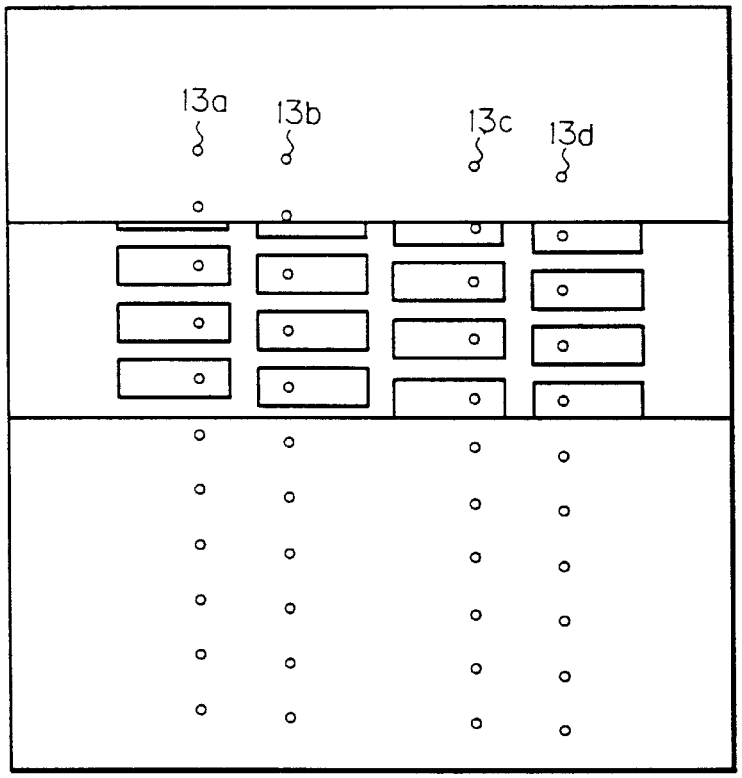
FIGS. 9A and 9B are plan views showing the third embodiment.
Figure 9B:
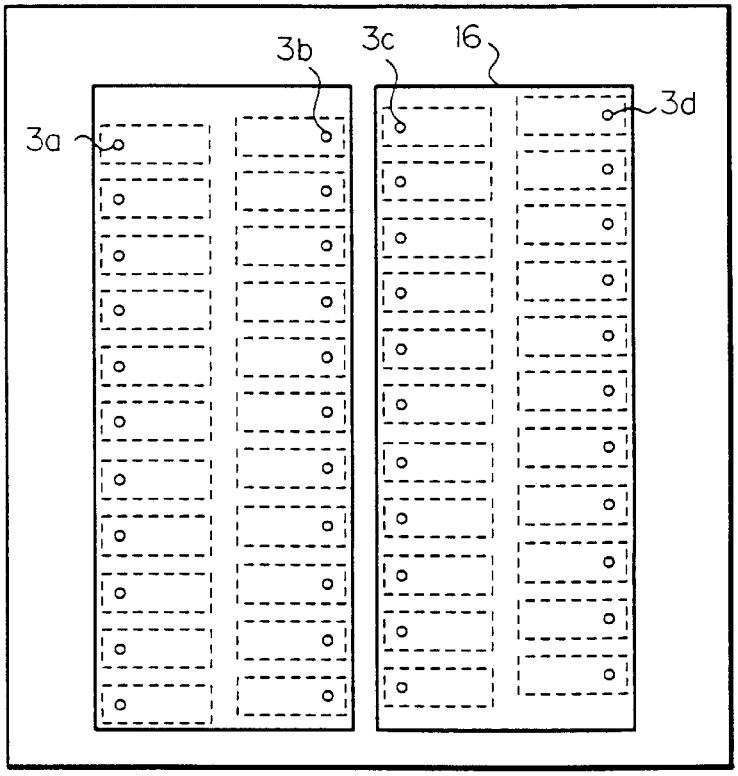

A third embodiment of the ink jet head in accordance with the present invention will be described with reference to FIGS. 8A. 8B, 9A, 9B and 10A–10K. FIGS. 8A and 8B are respectively a front view and a side elevation showing an ink jet head formed with a plurality of arrays of nozzles. There are shown in FIGS. 8A and 8B passageways 15, grooves 16 in the rear of a substrate, compression chambers 17, and partitions 18. FIGS. 9A and 9B are respectively a partly sectioned plan view and a bottom view of the head. There are shown in FIGS. 9A and 9B through holes 3*a*, 3*b*, 3*c* and 3*d* for burying a conductor, and nozzles 13*a*, 13*b*, 13*c* and 13*d*. FIGS. 10A–10K demonstrate a procedure for producing the head and shows an Ni film 19 formed by plating, dry films 23*a* and 23*b*, and an opening O as well as other structural elements. Briefly, in the illustrative embodiment, the rear of the glass substrate (opposite to the surface where the counter electrode 7 is formed) is partly thinned, and a through hole is formed in the thinned portion of the substrate. With this configuration, it is possible to facilitate the formation of the through hole while preserving the mechanical strength of the entire substrate 1.

Specifically, as shown in FIGS. 8A, 8B, 9A and 9B, the 16 are formed in the rear of the glass substrate 1 where the counter electrodes are not formed, thereby facilitating the formation of the through holes. Because this embodiment includes electrodes led out to the rear of the substrate 1 via the through holes, four or more arrays of nozzles can be arranged. This eliminates the need for pad regions in a chip area and thereby increases the number of devices for a single wafer. In addition, bumps included in the embodiment further promote easy mounting. The glass substrate 1 is of the kind having a coefficient of thermal expansion close to that of single crystal Si in the temperature range of from 200° C. to 400° C.

Figure 10A:
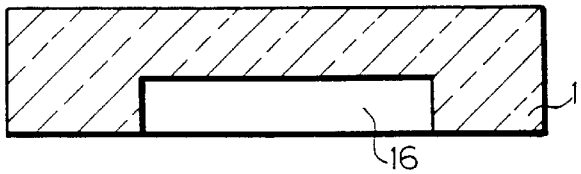
FIGS. 10A–10K demonstrate a procedure for producing the head of the third embodiment.
Figure 10B:
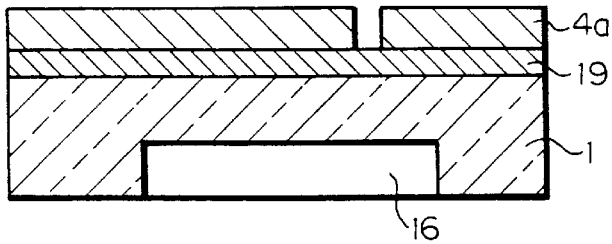

As shown in FIG. 10A, the side of the glass substrate 1, which is 400 μm thick, where the counter electrode 7 is formed is subjected to bead blasting in order to form the rear grooves 16. The rear grooves 16 are 350 μm deep, so that the glass substrate 1 is 50 μm thick at its portions corresponding to the grooves 16. While one rear groove 16 is assigned to each compression chamber, it may extends throughout the nozzle array area As shown in FIG. 10B, the Ni film 19 is formed on the substrate 1 by a plating liquid for a sulfamic acid bath, and then organic resist 4*a* formed with a through hole pattern by photolithography-is provided on the Ni film 19. The Ni film 19 is etched by an chant containing nitric acid, acetic acid and acetone in a ratio of 1:1:1. The etched Ni film 19 is used as a mask for glass etching.

Figure 10C:
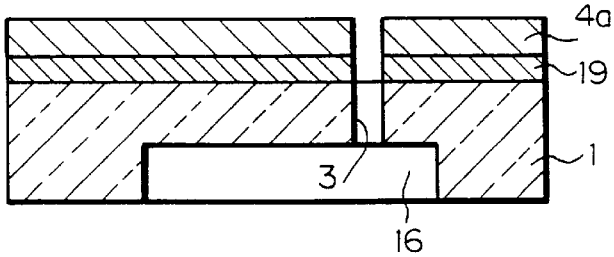
Figure 10D:
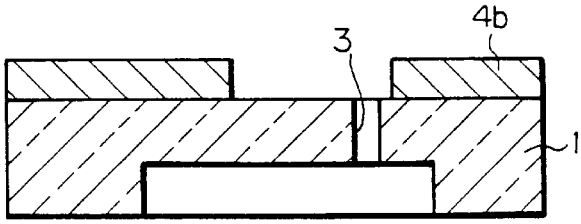
Figure 10E:
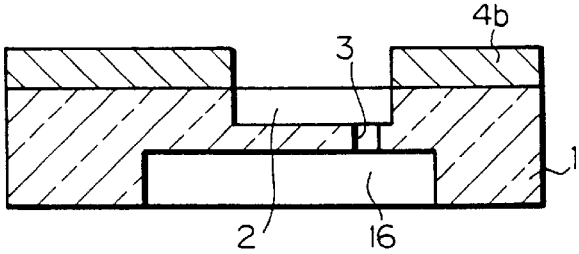
Figure 10F:
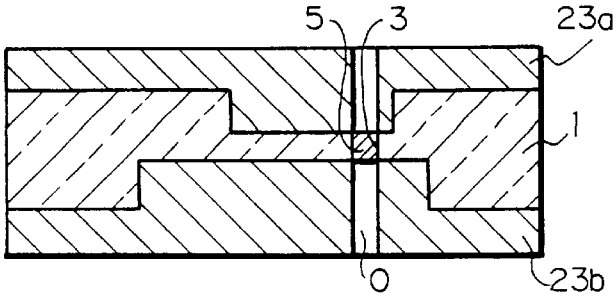
Figure 10G:
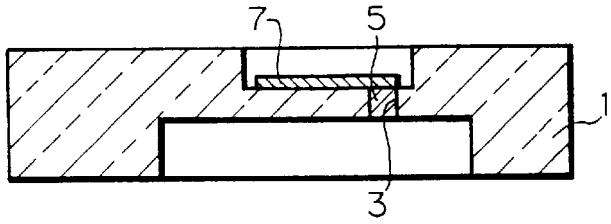

As shown in FIG. 10C, the substrate 1 is etched by dry etching using a CHF3 and SF6 gas mixture, and the Ni film 19 is removed by an etchant in order to form the through holes 3. Subsequently, as shown in FIG. 10D, organic resist 4*b* formed with a groove pattern for gaps is formed by photolithography. As shown in FIG. 10E, the grooves 2 for gaps are formed by RIE using a CHF3 and SF gas mixture. As shown in FIG. 10F, after the dry films 23*a* and 23*b* have been respectively adhered to both sides of the substrate 1, a mask with the openings O communicating to the holes 3 is formed by photolithography. Then, Au plating is executed in order to form the conductors 5 respectively buried in the holes 3. Thereafter, the dry films 23*a* and 23*b* are moved to complete the through hole portions, as shown in FIG. 10G.

Figure 10H:
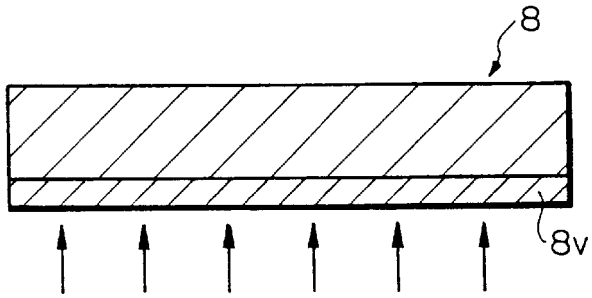
Figure 10I:
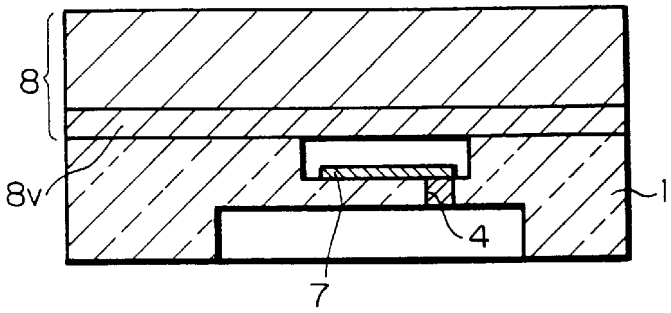

As shown in FIG. 10H, the (100) plane Si substrate 8 is subjected to ion implantation, diffusion or epitaxial growth in order to form a p-n junction implemented by a B (boron), P (phosphorus) or As (arsenic) impurity Layer. In the illustrative embodiment, the impurity layer constitutes the vibration plate 8*v*. The impurity layer is about 1.5 μm to 5 μm thick corresponding to the thickness of the desired vibration plate 8*v*. For the Si substrate 8, a p type substrate or an n type substrate will be respectively used for P, As or similar a type impurity or B or similar p type impurity. As shown in FIG. 10I, the glass substrate 1 and the impurity introduction surface of the Si substrate 8 are brought into contact with each other. After wiring has been so set up as to provide the glass substrate 1 with negative polarity via a needle electrode and provide a base electrode loaded with the Si substrate with positive polarity, the laminate is heated to 400° C. in air of atmospheric pressure or Ar, $N_2$, He or similar inactive gas. At the same time, 800 V is applied between the glass substrate 1 and the Si substrate 8. As a result, the two substrates 1 and 8 are anodically bonded together.

Figure 10J:
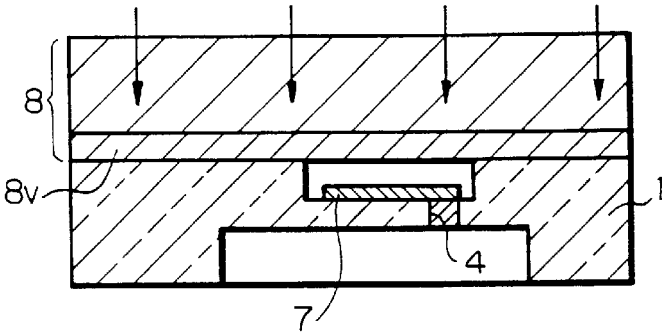
Figure 10K:
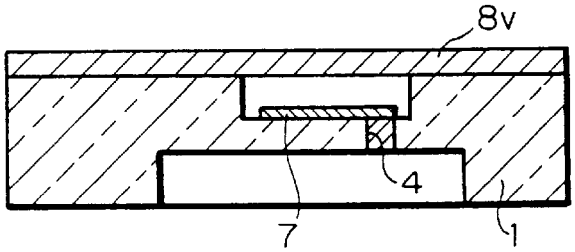

As shown in FIG. 10J, the Si substrate 8 is subjected to electrochemical etching. At this instance, a fluorocarbon resin jig for protecting the rear of the glass substrate 1 is implemented by Neoflon or similar polychlorotrifluoroethylene which is a hard material. An O ring should preferably be implemented by ALKREZ (trade name) available from Dupont. The electrochemical etching method depends on the conductivity type of the impurity layer corresponding in thickness to the vibration plate. For an n type impurity, for example, Au—Sb alloy electrodes capable of implementing resistive contact are used and connected to the n region, using the portions where the Si substrate is exposed to the orientation flat of the glass substrate 1. While the electrode (n type Si) and Pt electrode are respectively provided with positive polarity and negative polarity, the laminate is immersed in a 90° C. 20% KOH aqueous solution and applied with a voltage of about 1.0 V. As a result, the p type layer is entirely etched out while only the n type layer is left and constitutes the vibration plate 8*v*. On the other hand, as for a p type impurity, it is generally accepted that if the B density is as high as 1E20 or so, the etching rate of the p type layer is noticeably lowered. This allows only the p layer to be left, as shown in FIG. 10K For the etchant, use may be made of an aqueous solution of ethylenediamine and pyrocatecol. Finally, the glass substrate 1 with the vibration plate 8*v* is removed from the etching jig and then diced to form an actuator portion.

FIGS. 11A–11L show a fourth embodiment of the ink jet head in accordance with the present invention. Briefly, a glass substrate formed with grooves for gaps and electrodes and an Si substrate with an impurity introduced therein are anodically bonded together. Then, the glass substrate is thinned to a preselected thickness by grinding in order to facilitate the formation of through holes in the substrate.

Figure 11A:
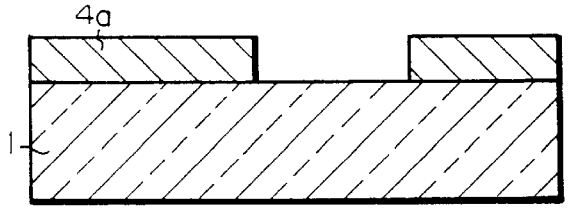
FIGS. 11A–11L show a fourth embodiment of the present invention.
Figure 11B:
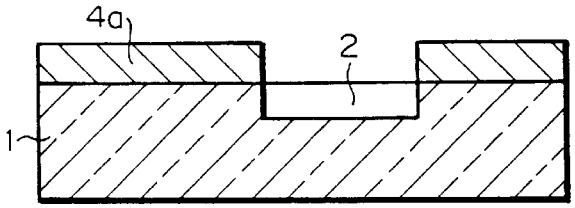
Figure 11C:
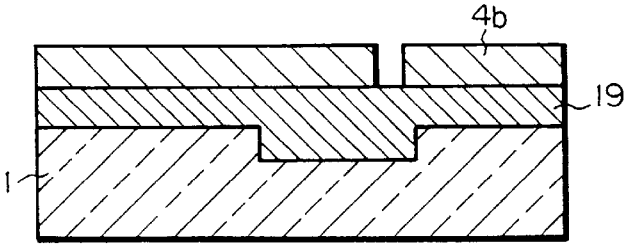
Figure 11D:
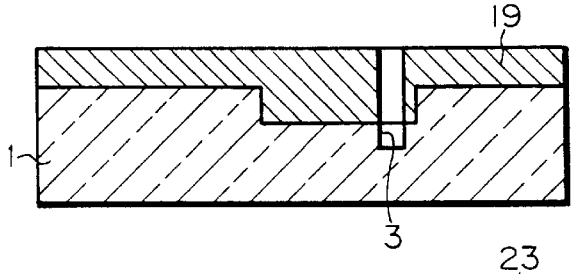
Figure 11E:
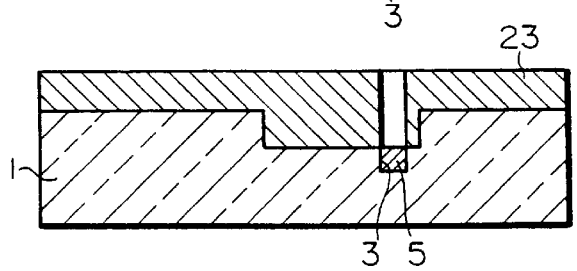
Figure 11F:
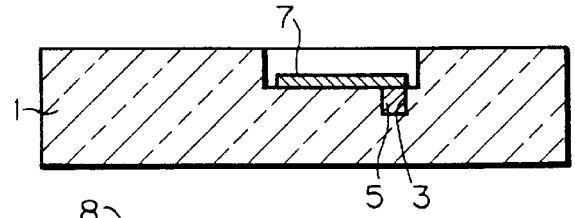

As shown in FIG. 11A, the organic resist film 4*a* formed with a gap pattern by photolithography is formed on the glass substrate 1. As shown in FIG. 11B, the glass substrate 1 is subjected to dry etching using a CHF3 and SF6 gas mixture so as to form the groove 2. As shown in FIG. 11C, after the rear of the glass substrate 1 has been protected by a jig, the Ni firm 19 is formed by plating on the surface where groove 2 is present, and a through hole pattern is formed in the organic resist 4*b* by photolithography. As shown in FIG. 11D, the glass substrate 1 is etched to a depth of 50 $\mu$m by dry e using a CHF3 and SP6 gas mixture while being masked by the Ni film 19. As a result, the through hole 3 is formed in the glass substrate 1. As shown in FIG. 11E, after a dry film 23 has been adhered to the front of the glass substrate 1 and then patterned, the through hole portion is subjected to Au plating. Subsequently, a 0.2 $\mu$m thick Ni film not shown, is formed by sputtering. Further, an organic resist film open in the form of a counter electrode pattern is formed by photolithography. The resulting laminate is etched by an Ni etchant so as to remove the organic resist. As a result, the counter electrode 7 is formed, as shown in FIG. 11F.

Figure 11G:
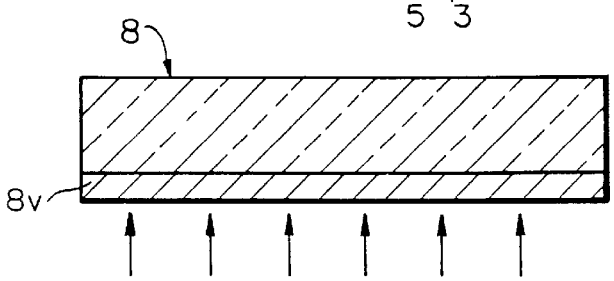
Figure 11H:
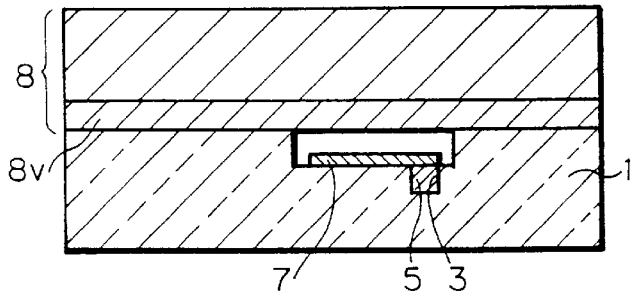

As shown in FIG. 11G, an impurity is introduced into the Si substrate 8 to a depth corresponding to the thickness of the vibration plate 8*v* in order to form the impurity layer or plate 8*v*. As shown in FIG. 11H, the glass substrate 1 and the side of the Si substrate 8 where the impurity has been introduced are anodically bonded together by the following procedure. First, the glass substrate 1 and the above surface of the Si substrate 8 are brought into contact, as in the third embodiment. Then, wiring is so set up as to provide the glass substrate 1 with negative polarity via a needle electrode and provide the Si substrate 8 with positive polarity. In this condition, the laminate is heated to 400° C. in air of atmospheric pressure or an Ar, $N_2$, He or similar inactive gas while 800 V is applied to the needle electrode, thereby effecting anodic bonding.

Figure 11I:
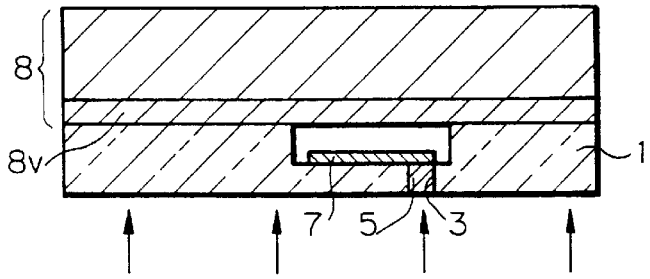
Figure 11J:
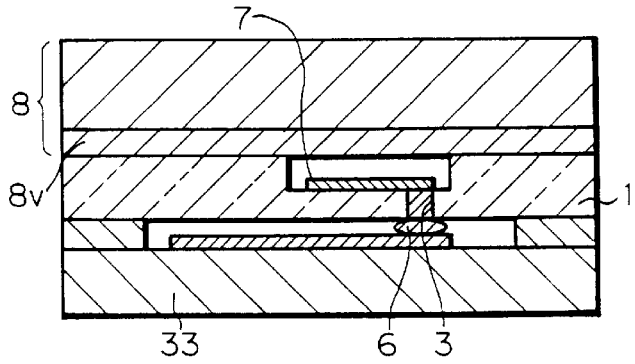
Figure 11K:
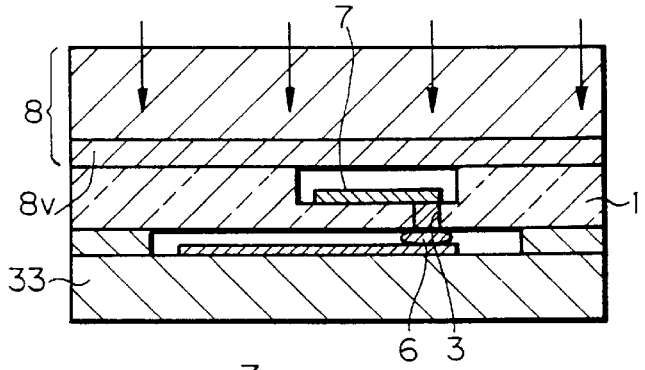
Figure 11L:
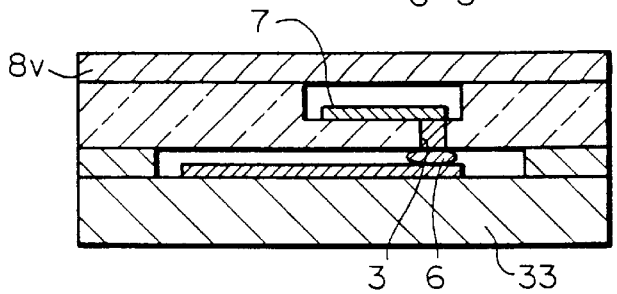

As shown in FIG. 11I, the glass substrate 1 is ground such that glass remains with a thickness of 50 $\mu$m in the portion where the groove 2 is formed. As a result, Au buried in the through hole 3 is exposed to the outside. As shown in FIG. 11J the ground surface of the glass substrate 1 and a drive circuit substrate 33 formed with a drive circuit are bonded by thermocompression after the alignment of the conductor bump 6. Alternatively, there may be effected a sequence of steps of forming a drive circuit on the Si substrate 8 by any conventional semiconductor device technology, partly exposing Si, forming the bumps 6 on the substrate Si, aligning the rear of the glass substrate 1 and the drive circuit substrate 33, and anodically bonding them at about 300° C. Subsequently, as shown in FIG. 11K, after a jig has been mounted to the glass substrate 1, electrochemical etching is executed in the same manner as in FIG. 11J in order to form the vibration plate or impurity layer 8*v*. After the jig has been removed from the glass substrate, it is diced to complete the actuator portion of the head. By such procedure, a sixty-four nozzle, four array ink jet head was achieved with a chip size of 13 mm×13 mm.

Figure 12:
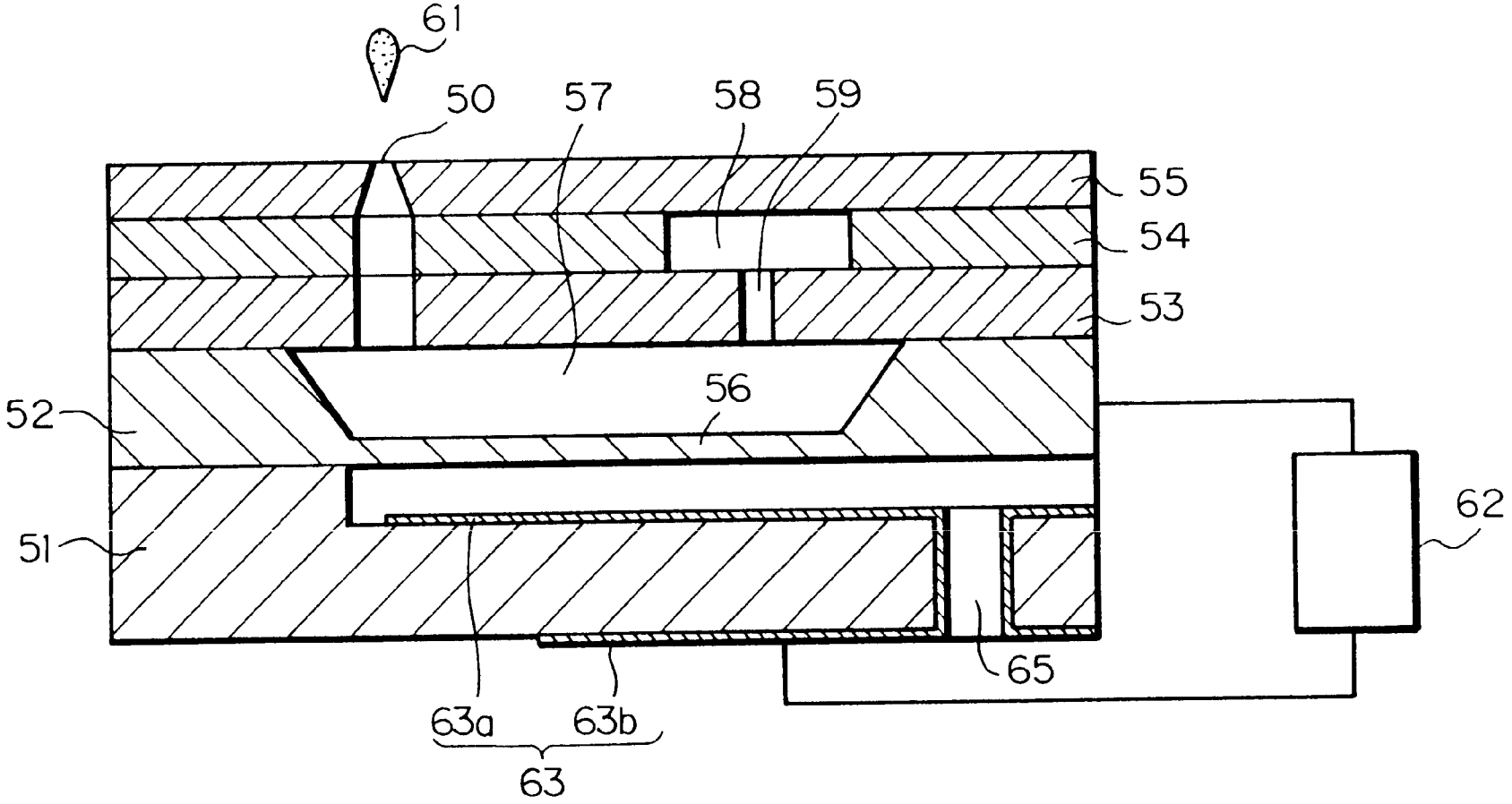
FIG. 12 is a fragmentary section showing a fifth embodiment of the present invention.

A fifth embodiment of the present invention will be described with reference to FIG. 12. There are shown in FIG. 12 an electrode substrate 51, a vibration plate substrate 52, passageway substrates 53 and 54, a nozzle plate 55, a vibration plate 56, a compression chamber 57, an ink feed passageway 58, an ink resistance passageway 59, an ink drop 61, a drive circuit 62, and a front electrode 63*a* and a rear electrode 63*b*, collectively labeled 63. FIG. 12 shows a condition in which the vibration plate substrate 52 and electrode substrate 51 are processed in a wafer size and then cut away after assembly to produce a single head. The reference numeral 65 designates a hole.

The processing and assembly of the vibration plate substrate 52 and electrode substrate 51 and the separation of a single head were effected, as follows. For the vibration plate substrate 52, use was made of (100) Si sized 4 itches and 200 $\mu$m thick, A thermally oxidized $SiO_2$ film was patterned in accordance with the configuration of the chamber 57. The substrate 52 was etched by KHO via the patterned $SiO_2$ film or mask, so that the vibration plate 56 was left with a thickness of 10 $\mu$m. The vibration plate 56 was 2 mm long longitudinally and 0.2 mm long laterally. For the electrode plate 51, use was made of Pilex glass having substantially the same coefficient of thermal expansion as Si and capable of being anodically bonded to maintain a small gap between the vibration plate 56 and the electrode.

Figure 13A:
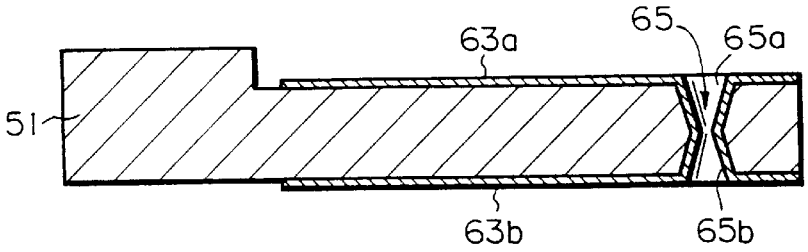
FIGS. 13A–13C show an electrode substrate included in the fifth embodiment in detail.
Figure 13B:
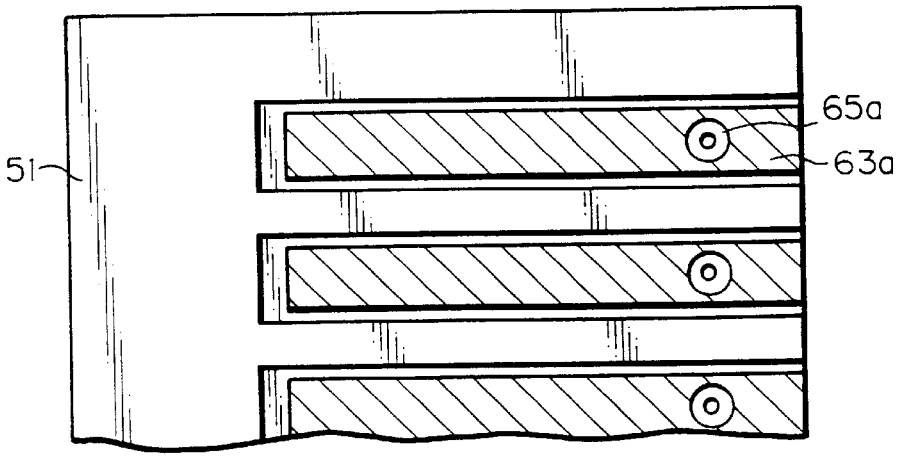
Figure 13C:
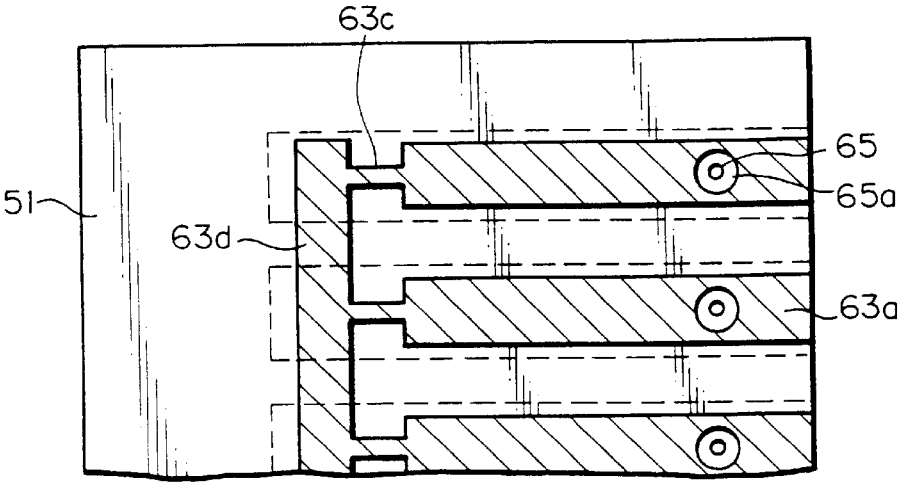

FIGS. 13A–13C show the electrode substrate 51 in detail As shown, the through holes 65 ire formed in the glass substrate 51 outside of the areas facing the vibration plates 56. The holes 65 may be formed in the substrate 51 in any one of various methods known in the art. However, when the electrodes 63*a* on the front are led out to the rear, it is necessary to facilitate the formation of electrode films in the holes 65 and to prevent the electrodes from becoming cut off around the holes 65. Experiments showed that sand blasting is most desirable because it provides each hole 65 with tapers 65*a* and 65*b* and allows its edges to be gently inclined. Specifically, after the lamination of dry film resist to a 4 inch, 0.5 mm thick glass, and the following exposure and development, holes were formed in the glass in a pattern representative of the holes 65. Subsequently, sand blasting was effected from the front of the glass The resulting tapered holes 65 each had an inlet diameter of 200 $\mu$m and had a minimum diameter of 130 $\mu$m at tie center in the direction of thickness.

As shown in FIG. 13A, a 1 $\mu$m deep groove was formed in the front of the electrode substrate 51 facing the vibration plate 56 by buffered hydrofluoric acid. Then, a 2,000 Å thick Ni film was formed on the bottom of the groove by sputtering so as to form the electrode 63*a*. Also, a 2,000 Å thick Ni film was formed on the rear of the substrate 51, and then a 2,000 Å Au film was formed to constitute the electrode 63*b*; the Au film enhances the adhesion of the substrate 51 to an FPC. As shown in FIG. 13C, the electrode pattern on the rear of the substrate 51 is formed such that each independent electrode 63*b* has a common electrode portion 63*c* via a bridge portion 63*c* to be cut.

Figure 14A:
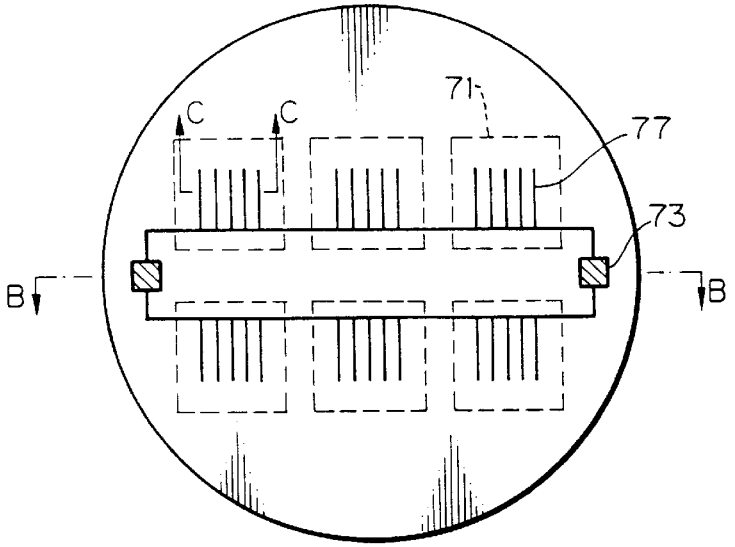
FIGS. 14A–14C show a specific configuration of the electrode substrate of the fifth embodiment in a wafer size.

FIG. 14A shows electrode substrates in a wafer size. In FIG. 14A, areas 71 indicated by dotted lines each corresponds to one ink jet head; six heads 71 are available with a single wafer. Independent electrodes 77 are connected to electrodes 73 for anodic bonding by a common portion. The vibration plate substrate and electrode substrate formed in a wafer size were aligned by use of alignment marks and then brought into close contact with each other. The two substrates were sandwiched between an upper and a lower plate for anodic bonding and then bonded at 350° C. with a voltage of −350 V being applied to the glass side.

Figure 14B:
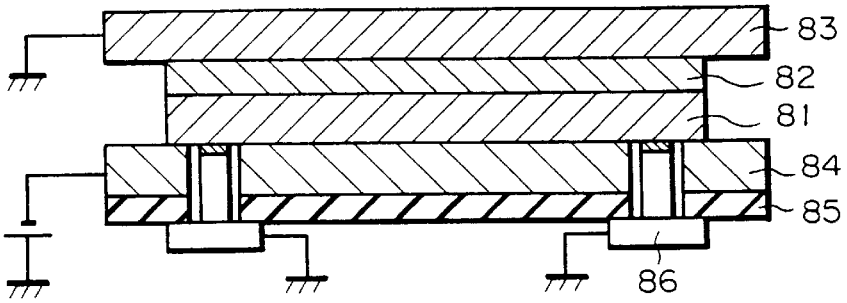
Figure 14C:
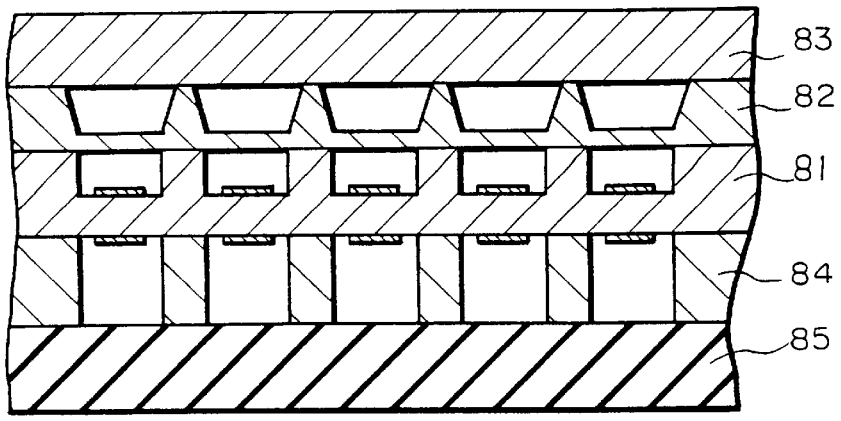

FIG. 14B is a section along line B—B of FIG. 14A. As shown a voltage is applied between the vibration plate substrate 82 and the electrode substrate 81 via an upper plate 83 and a lower plate 84 which are conductive. The electrodes are held at the same potential as the upper plate 83 and vibration plate substrate 82 via. e.g., pins 86 received in openings formed in the lower plate 84 and an insulating plate 85. FIG. 14C is a section along line C—C of FIG. 14A. As shown, openings are also formed in the lower plate 84 in order to prevent the plate 84 from contacting the rear electrodes.

After anodic bonding, the electrode substrate portion was cut away by a laser. Then, a groove extending from the vibration plate side to a part of the electrode substrate was formed by a dicing saw. Heads each having a plurality of compression chambers and electrodes respectively corresponding to the chambers were separated. Subsequently, the nozzle plate and passageway plates bonded together beforehand were aligned with the vibration plate substrate and then bonded. The nozzle plate and passageway plates were respectively formed by electroforming Ni and by etching stainless steel. To bond the nozzle plate, passageway plates and vibration plate substrate, use was made of epoxy adhesive. An FPC corresponding in pitch to the independent electrodes led out to the rear of the electrode substrate was prepared and soldered to the electrodes for a test. While a voltage was applied to the electrodes, the displacements of the vibration plates were measured by a laser Doppler vibrometer. The test showed that desirable electrical connection is achievable.

The prerequisite with electrical connection using the FPC is that the electrodes be prevented from being cut off around the holes on the rear of the electrode substrate due to careless handling. To meet this requirement and to enhance rigid bonding of the electrodes with the FPC, methods respectively shown in FIGS. 15A, 15B and 16B were tested.

Figure 15A:
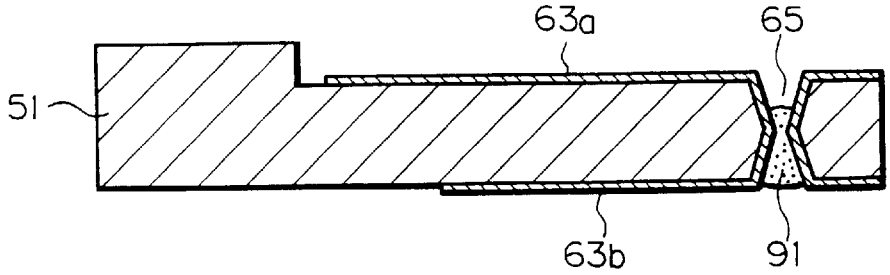
FIGS. 15A and 15B show another specific configuration of the electrode substrate of the fifth embodiment.
Figure 15B:
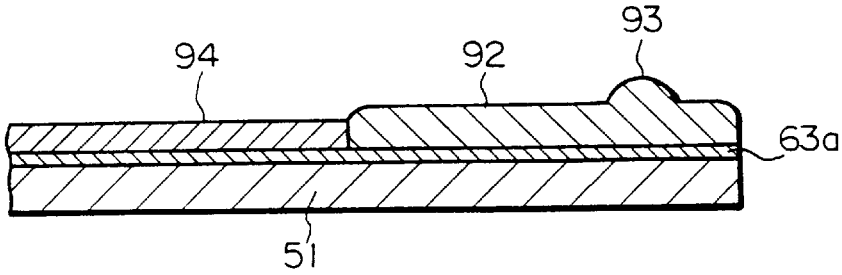

In FIG. 15A, each hole 65 formed in the electrode substrate 51 is filled with conductive adhesive 91. Specifically, after anodic bonding, a preselected amount of adhesive 91 is injected into the hole 65 by a dispenser at the wafer level and then cured by heat. In FIG. 15B, solder 92 provided on the FPC has its portion 93 corresponding to the hole protruded and then melted by heat to fill the hole; labeled 94 is an electrode protection layer. Both of the methods shown in FIGS. 15A and 15B were found to increase the bonding strength.

Extended researches and experiments showed that when the electrode substrate is thin, it is apt to break during handling or during pressurization for anodic bonding. Although the thickness may be simply increased to solve the above problem, such a scheme prevents the hole from extending throughout the plate during sand blasting or requires the inlet of the hole to have a larger diameter for perforation, i.e., requires a greater pitch between nearby electrodes, as also determined by experiments.

Figure 16:
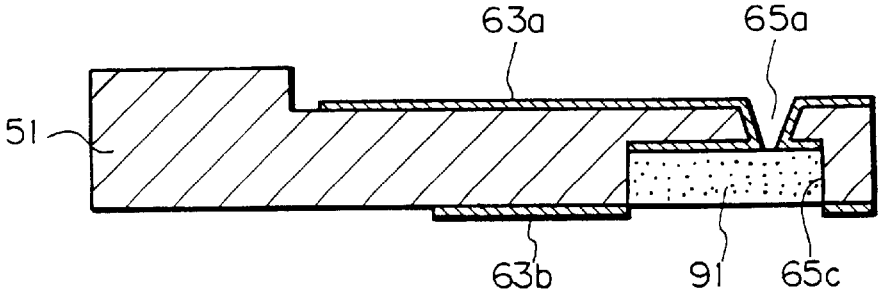
FIG. 16 shows still another specific configuration of the electrode substrate including a stepped portion.

In FIG. 16, the electrode substrate 51 is formed with a stepped portion 65*c*. The stepped portion 65*c* was 0.8 mm deep and formed by effecting sand blasting from the rear of the electrode plate 51 implemented by Pilex glass. The tapered hole 65*a* having an inlet diameter of 200 $\mu$m and a minimum diameter of 130 $\mu$m at the center in the direction of thickness was formed by effecting sand blasting from the front of the substrate 51. The conductive adhesive 91 was filed in the stepped portion 65*c* and then dried by heat. When the FPC was soldered to the substrate 51, desirable electrical connection was set up.

Figure 17A:
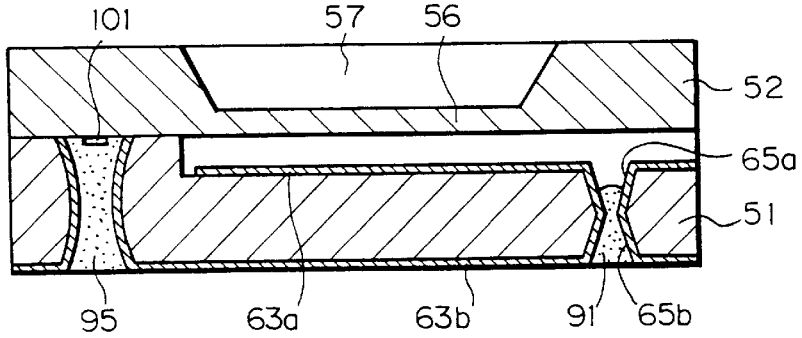
FIGS. 17A and 17B are fragmentary sections showing a sixth embodiment of the present invention.
Figure 17B:
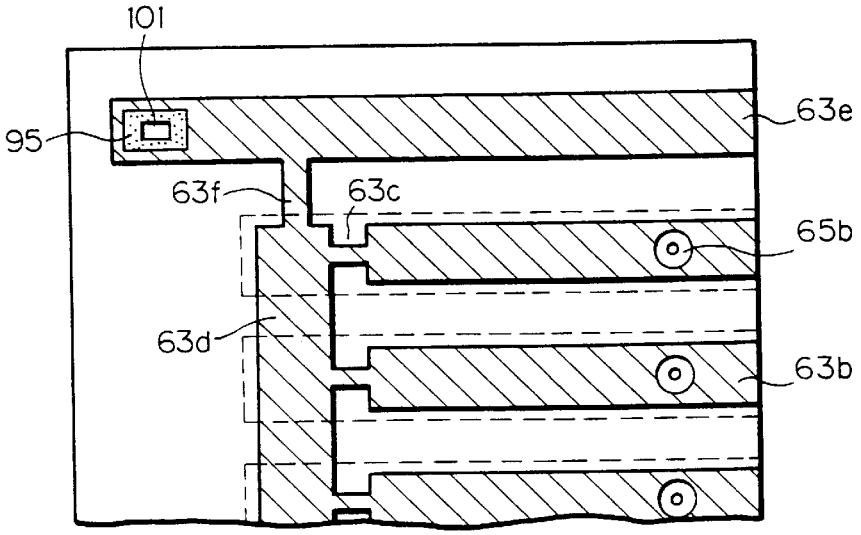

FIGS. 17A an 17B show a sixth embodiment of the ink jet head in accordance with the present invention. Specifically, FIG. 17A shows how the electrode 63*a* of the electrode substrate 51 and the electrode of the vibration plate substrate 52 are led out to the rear of the electrode substrate 51. Au was deposited on the rear of p type Si and then sintered to form an Ohmic film 101. The tapered through hole was formed in the electrode substrate 51 and then filled with the conductive adhesive 95, as stated earlier. FIG. 17B shows the head in a plan view. As shown, the electrode pattern led out to the rear of the electrode substrate 51 has independent electrodes 63*b*, an electrode 63*e* assigned to the vibration plate substrate 52, an a common portion 63*d*. As for potential, the electrodes 63*b*, 63*e* and 63*d* are held in the same condition as stated with reference to FIG. 14B at the time of wafer size anodic bonding. After anodic bonding, the electrodes 63*b*, 63*e* and 63*d* are cut away from each other at portions 63*c* and 63*f*. Experiments with an FPC proved that the above configuration implements desirable electrical connection and mechanical strength.

The embodiments described so far has some points to be improved, as follows.

(1) Assume that the counter electrodes have a pitch of 330 $\mu$m (75 dots per inch or dpi) and a width of 300 $\mu$m. Then, even when through holes are formed in a 1 mm thick glass substrate and filled with a conductor, it is difficult to reliably bury the conductor in the holes. To enhance reliability, the glass substrate must have its thickness reduced.

(2) It is difficult to form through holes each having an inlet diameter of less than 100 $\mu$m in, e.g., a 1 mm thick substrate. Therefore, the above embodiments are not feasible for dense arrangements.

Embodiments capable of solving the problems (1) and (2) will be described hereinafter.

Figure 18:
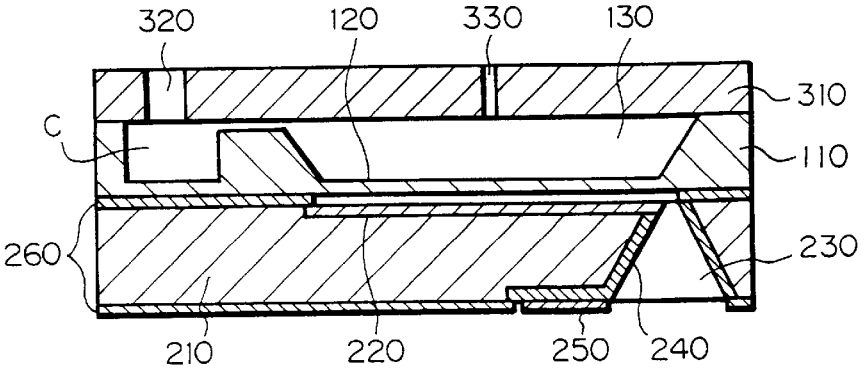
FIG. 18 is a fragmentary section showing a seventh embodiment of the present invention.

Referring to FIG. 18, a seventh embodiment of the ink jet head in accordance with the present invention is shown. As shown, the head includes a vibration plate substrate 110 and an electrode substrate 210 including a counter electrode 220 facing the vibration plate 120. The head is shown in a condition cut away in the form of a chip after the processing and assembly of the substrates 110 and 120. The vibration plate substrate 110 is implemented by an Si wafer having, e.g., a (100) plane or a (110) plane on the front. The Si wafer is grooved in accordance with an ink chamber pattern, so that the vibration plate 120 which is 5 $\mu$m thick is formed. The electrode substrate 210 constituting the counter electrode 220 facing the vibration plate 120 is implemented by an Si wafer having, e.g., a (100) plane or a (110) plane on the front. The counter electrode 220 facing the vibration plate 120 is positioned on the electrode substrate 210. The vibration plate 120 and counter electrode 220 are spaced from each other by a small gap.

A through hole 230 extends from the rear to the front of the electrode substrate 210 outside of the area facing the vibration plate 120 and in alignment with the counter electrode 220. A lead-out electrode 240 is formed on the wall of the through hole 230 and formed of an impurity whose conductivity is opposite to the conductivity of the electrode substrate 210. The counter electrode 220 adjoining the front of the electrode substrate 210 is led out to the rear of the substrate 210 via the lead-out electrode 240. If desired, the through hole 230 may be replaced with a bore leaving a wall of several microns so long as sufficient electrical conduction can be set up between the counter electrode 220 and the lead-out electrode 240.

A metal pad 250 for mounting is formed on the lead-out electrode 240 The two substrates 110 and 210 are joined together by, e.g., Si—Si direct bonding. Further, a nozzle substrate 310 formed with an ink inlet port 320 and an ink ejection port or nozzle bole 330 is bonded to the substrate 110. In FIG. 18, labeled C is a common ink chamber.

Figure 19A:
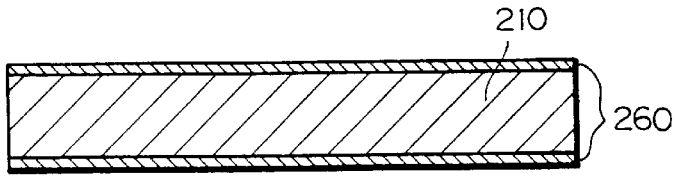
FIGS. 19A–19F are sections demonstrating a procedure for producing the seventh embodiment.

A procedure for producing the head of FIG. 18 will be described with reference to FIGS. 19A–19F. First, as shown in FIG. 19A, thermally oxidized films 260 are respectively formed on the front and rear of the electrode substrate 210 which is implemented by a p type (110) Si wafer. The film 260 on the front defines a gap between the vibration plate 120 and the counter electrode 220. When a voltage is applied between the vibration plate 120 and the counter electrode 220, an electrostatic force acts in the above gap and pulls the vibration plate 120 toward the counter electrode 220. When the electrostatic force is cancelled, ink in the Si ink chamber 130, FIG. 18, is ejected from the nozzle hole 330. The p type (110) Si wafer may be replaced with a (100) Si wafer, if desired. Also, an n type wafer may be used in place of the p type wafer.

Figure 19B:
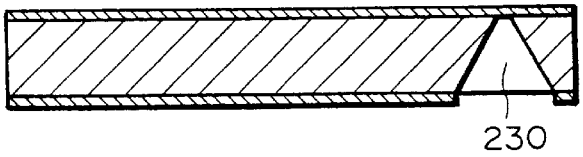
Figure 20A:
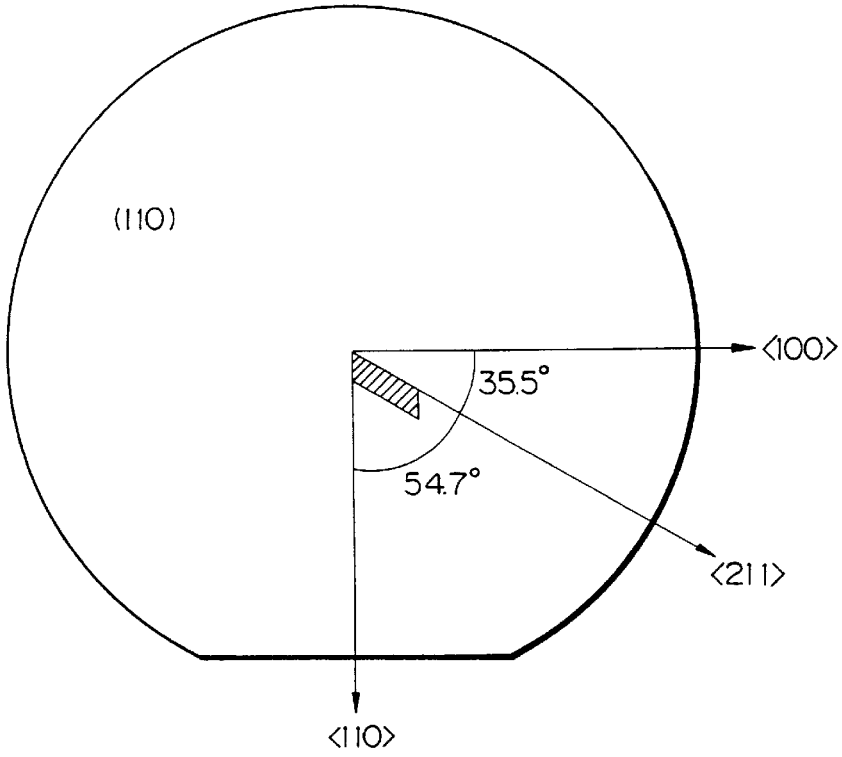
FIGS. 20A–20D show a specific configuration of a window to be formed in an electrode substrate implemented by a (110) Si wafer.

As shown in FIG. 19B, a photoresist mask is formed by photolithography on the rear of the electrode substrate 210 carrying the thermally oxidized film 260, and then the film 260 is etched by buffered hydrofluoric acid via the mask so as to form a window. As shown in FIG. 20A, the window may have a rectangular configuration (indicated by hatching) defined by the <211> orientation and <110> orientation making an angle of 54.7 degrees therebetween. The substrate 210 is etched by anisotropic etching using, e.g., TMAH (tetramethyl ammonium) via the rectangular window. As a result, the through hole (FIG. 19B) or the bore (FIGS. 20B–20D) is defied by two <111> planes perpendicular to the wafer surface and two <111> planes inclined by 35.3 degrees relative to the wafer surface. TMAH may be replaced with, e.g., KOH or hydrazine, if desired.

Figure 20B:
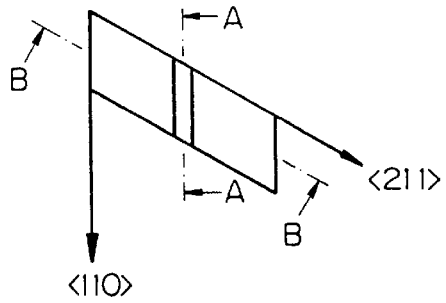
Figure 20C:
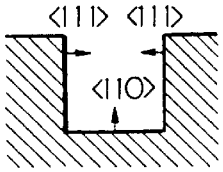
Figure 20D:
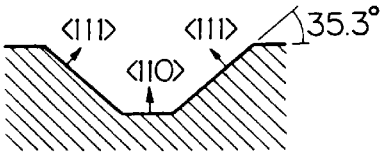

FIG. 20B is a plan view as seen from the window side after the anisotropic etching of the hatched area of FIG. 20A. FIG. 20C is a section along line A—A of FIG. 20B while FIG. 20D is a section along line B—B of FIG. 20B.

Figure 21A:
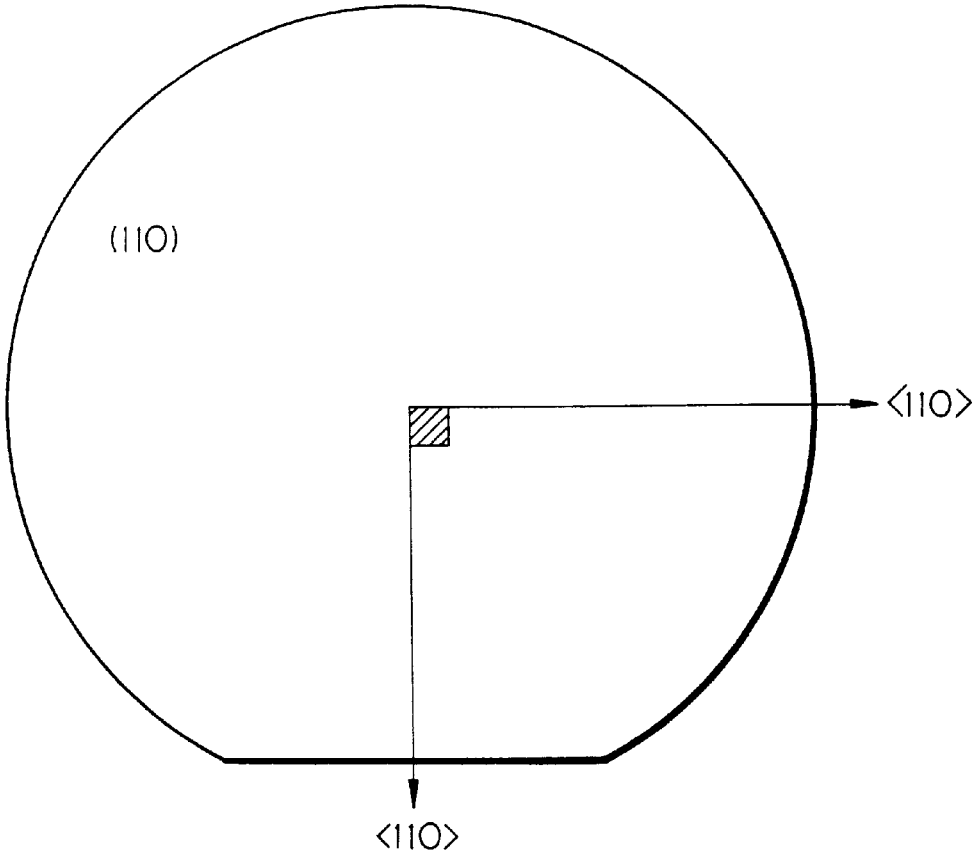
FIGS. 21A–21C show a specific configuration of a window to be formed in an electrode substrate implemented by a (100) Si wafer.

When use is made of a (100) Si wafer for the electrode substrate 201, the window may be provided with a square configuration defined by two perpendicular <110> orientations, as shown in FIG. 21A. The substrate 210 is etched by anisotropic etching using, e.g., TMAH via the square window. As a result, the through hole (FIG. 19B) or the bore (FIGS. 20B–20D) is defined by four <111> planes inclined by 54.7 degrees relative to the wafers surface. Again, TMAH may be replaced with, e.g., KOH, NaOH (sodium hydroxide), or hydrazine.

Figure 21B:
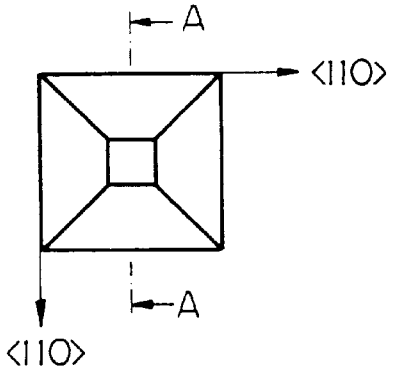
Figure 21C:
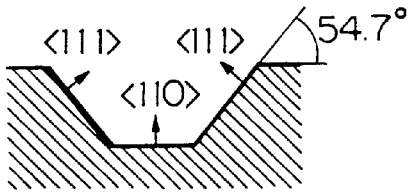

FIG. 21B is a plan view as seen from the window side after the anisotropic etching of a hatched area shown in FIG. 21A. FIG. 21C is a section along line A—A of FIG. 21C. In FIGS. 20A–20D and 21A–21C, a bore is substituted for a through hole.

Figure 19C:
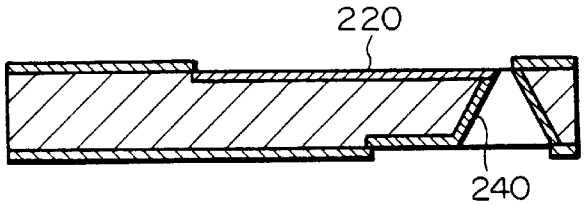

As shown in FIG. 19C, the thermally oxidized films 260 formed on both sides of the electrode substrate 210 are partly etched by buffered hydrofluoric acid via a photoresist mask, not shown, formed by photolithography, thereby forming the window. Then, solid phase diffusion using, e.g., a phosphorus plate is effected on the Si surface where the window is present. As a result, the lead-out electrode 240 is formed. At this instant, the counter electrode 220 and lead-out electrode 240 are electrically connected together. When the electrode plate 210 is implemented by an n type Si wafer, B, for example, Bay be used as a diffusion source, in which case the counter electrode 220 and lead-out electrode 240 will each be implemented as a p type high concentration layer.

Figure 19D:
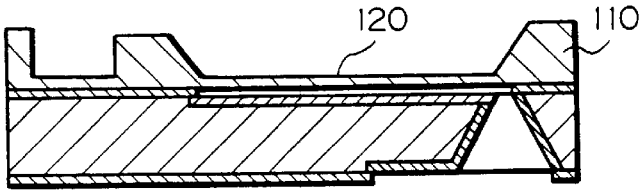

The vibration plate substrate 110 includes a 3 $\mu$m thick vibration plate 120 produced by the anisotropic etching of Si. As shown in FIG. 19D, the vibration plate substrate 110 is adhered to the electrode substrate 210. For adhesion, use may be made of Si—Si direct bonding effected with the intermediary of the thermally oxidized film 260 of the electrode substrate 210.

Figure 19E:
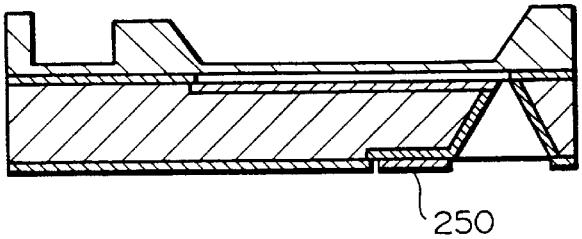
Figure 19F:
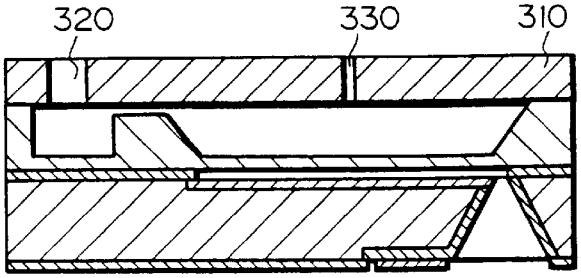
Figure 22:
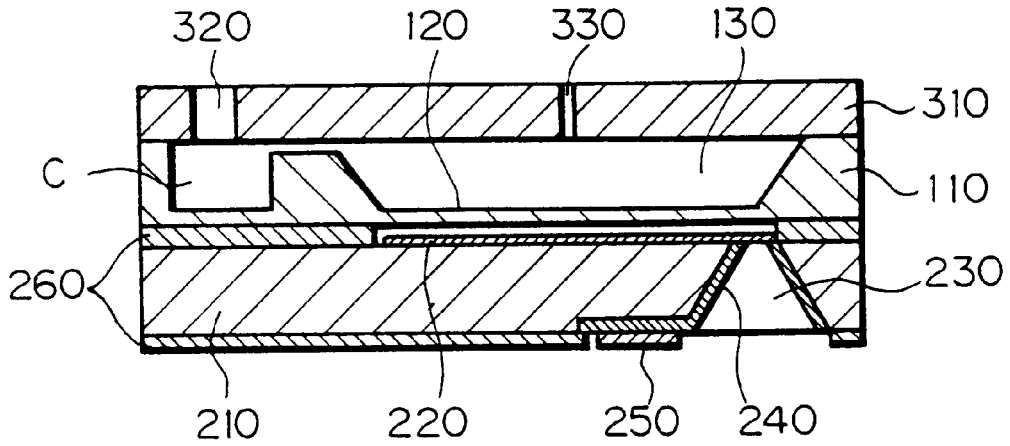
FIG. 22 is a fragmentary section showing an eighth embodiment of the present invention.

As shown in FIG. 19E, the metal pad 250 is formed on the diffusion layer of the rear of the electrode substrate 210 by vacuum deposition using a metal mask. The metal pad 250 may be formed of Al (aluminum) or Ti/Pt/Au by way of example. Finally, as shown in FIG. 19F, the nozzle substrate 310 formed with the nozzle hole 330 and ink inlet port 320 is aligned with the vibration plate substrate 110 and then adhered to the substrate 110 by epoxy adhesive, FIG. 22 shows an eighth embodiment of the ink jet head in accordance with the present invention will be described. This embodiment is identical with the seventh embodiment except that the counter electrode 220 is replaced with a metal electrode. Assume that when The electrode substrate 210 and vibration plate substrate 110 are adhered together after the formation of the metal electrode, Si—Si direct boding is used. Then, temperature as high as 1,000° C. or so is needed. In light of this, the metal electrode should preferably be implemented as a Ti film, W (tungsten) film or similar metal film highly resistive to heat.

Figure 23:
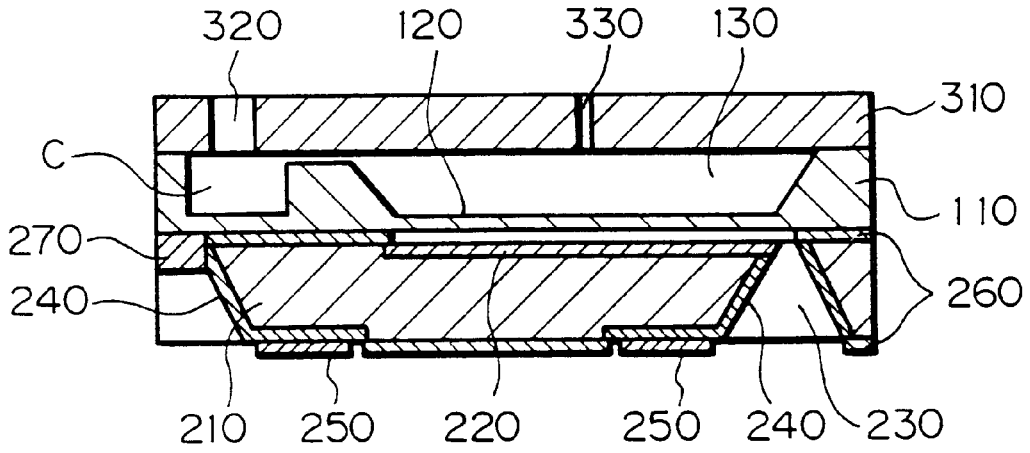
FIG. 23 is a fragmentary section showing a ninth embodiment of the present invention.

FIG. 23 shows a ninth embodiment of the ink jet head in accordance with the present invention. In the illustrative embodiment, not only an electrode associated with the counter electrode 220 but also the electrode associated with the vibration plate 120 of the sixth embodiment are led out to the rear of the electrode plate 21 so that the two electrodes can be mounted in the same plane. In this connection, in the seventh and eighth embodiments, an electrode, not shown, is affixed to a part of the front of the vibration plate substrate 110 so as to lead out the above electrode of the vibration plate 120. The lead-out electrode 240 assigned to the electrode of the vibration plate 120 and metal pad 250 can be formed at the same time as the lead-out electrode 240 associated with the counter electrode 220 and metal pad 250. The thermally oxidized film 260 5,000 Å thick and intervening between the electrode substrate 210 and the vibration plate substrate 110 prevents the two substrates 120 and 210 from being electrically connected together. The substrates 120 and 210 are brought into conduction when the conductive filler 270 is introduced and cured by beat.

Other embodiments of the present invention feasible for a device arrangement adaptive to higher dot densities or nozzle densities will be described hereinafter.

Figure 24:
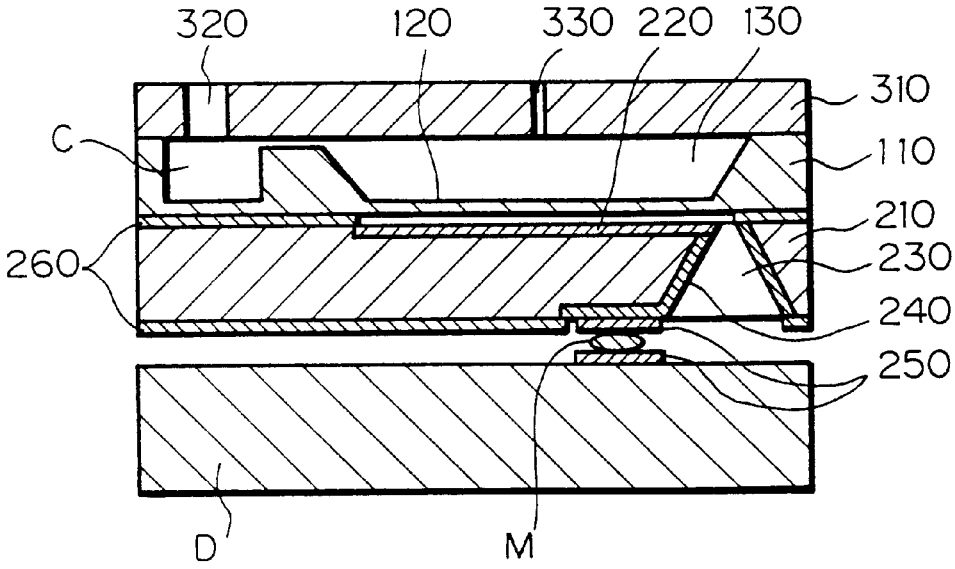
FIG. 24 is a fragmentary section showing an ink jet head cut into a chip after wafer size processing and assembly.

FIG. 24 shows an ink jet head in the form of a chip cut away after the wafer size processing and assembly of the vibration plate substrate 11 and electrode plate 210 In this embodiment, the vibration plate substrate 110 is implemented by, e.g., an Si wafer having a (100) plane or a (110) plane on its front. The Si wafer is grooved in accordance with the configuration of the ink chamber so as to form the vibration plate 120 which is 5 $\mu$m thick.

The electrode substrate 210 with the counter electrode 220 is implemented by. e.g., an Si wafer having a (100) plane or a (100) plane on the front. The counter electrode 220 is positioned on the substrate 210 such that it faces the vibration plate 120. A small gap exists between the vibration plate 120 and the counter electrode 220. The through hole 230 is formed from the rear w the front of the electrode plate 210 in alignment with the counter electrode 220, but outside of the area facing the vibration plate 120. The lead-out electrode 240 implemented by an impurity layer opposite in conductivity type to the electrode substrate 2 10 is formed on the wall of the through hole 230. The counter electrode 220 on the front of the substrate 210 is led out to the rear of the substrate 210 via the lead-out electrode 240. Again, the through hole 230 may be replaced with a bore leaving a wall of several microns so long as sufficient electrical conduction can be set up between the counter electrode 220 and the lead-out electrode 240. The metal pad 250 for mounting is formed on the lead-out electrode 240 on the rear of the substrate 210. Also shown in FIG. 24 are a driver chip D and a metal bump M.

The above vibration plate substrate 110 and electrode substrate 210 are bonded together by Si—Si direct bonding or similar technology. Further, the nozzle plate 310 with the ink inlet port 320 and ink ejection port or nozzle hole 330 is adhered to the substrate 10.

Figure 25:
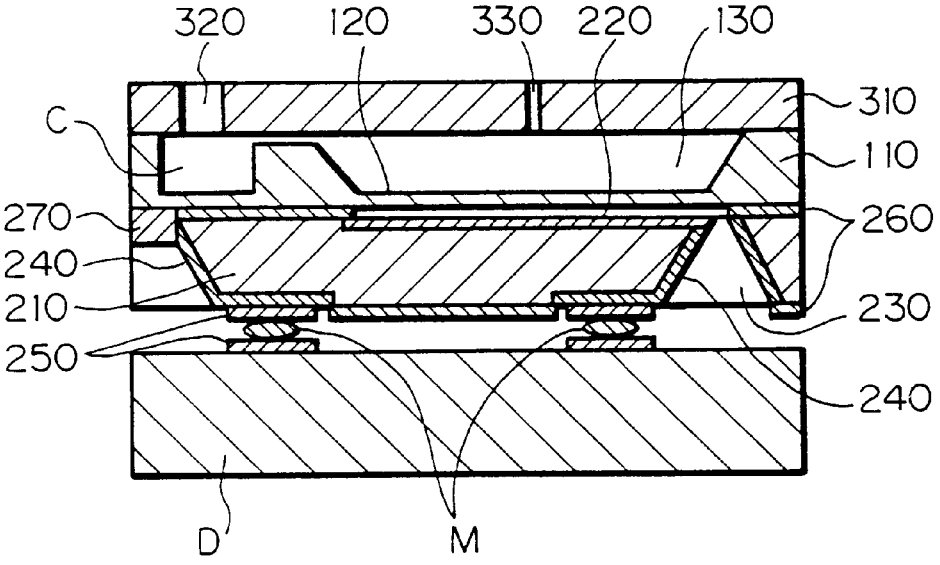
FIG. 25 is a view similar to FIG. 24, showing another ink jet head.

FIG. 25 shows an ink jet head in which not only tile electrode associated with the counter electrode 220 but also the electrode associated with the vibration plate 120 are led out to the rear of the electrode substrate 210, so that the two electrodes can be mounted in the same plane. In this connection, an electrode, not shown, is affixed to a part of the front of the vibration plate substrate 110 so as to lead out the above electrode of the vibration plate 120. The lead-out electrode 240 associated with the vibration plate 120 and metal pad 250 can be formed at the same time as the lead-out electrode 240 associated with the counter electrode 220 and metal pad 250. The thermally oxidized film 260 5,000 Å thick and intervening between the electrode substrate 210 and the vibration plate substrate 110 prevents the two substrates 120 and 210 from being electrically connected together. The substrates 120 and 210 are brought into conduction when the conductive filler 270 is introduced and cured by heat.

Figure 26A:
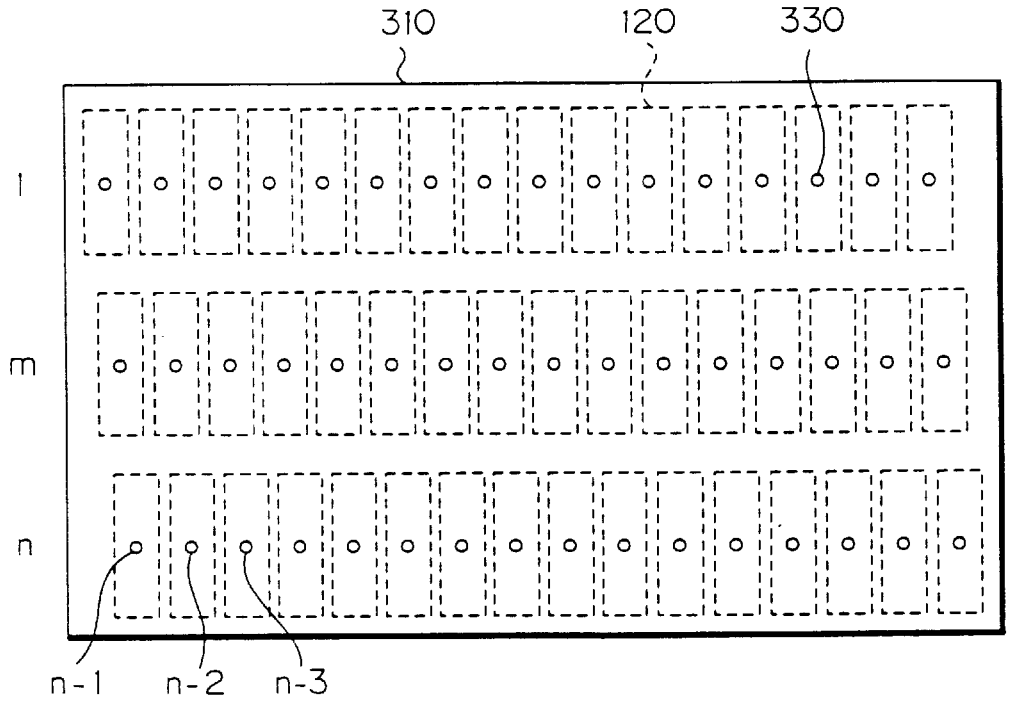
FIGS. 26A and 26B are plan views showing a specific array arrangement-of an ink jet head.
Figure 26B:
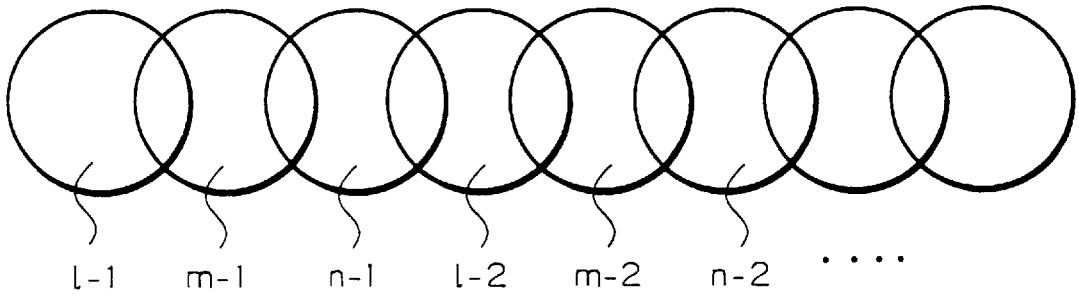
Figure 27:
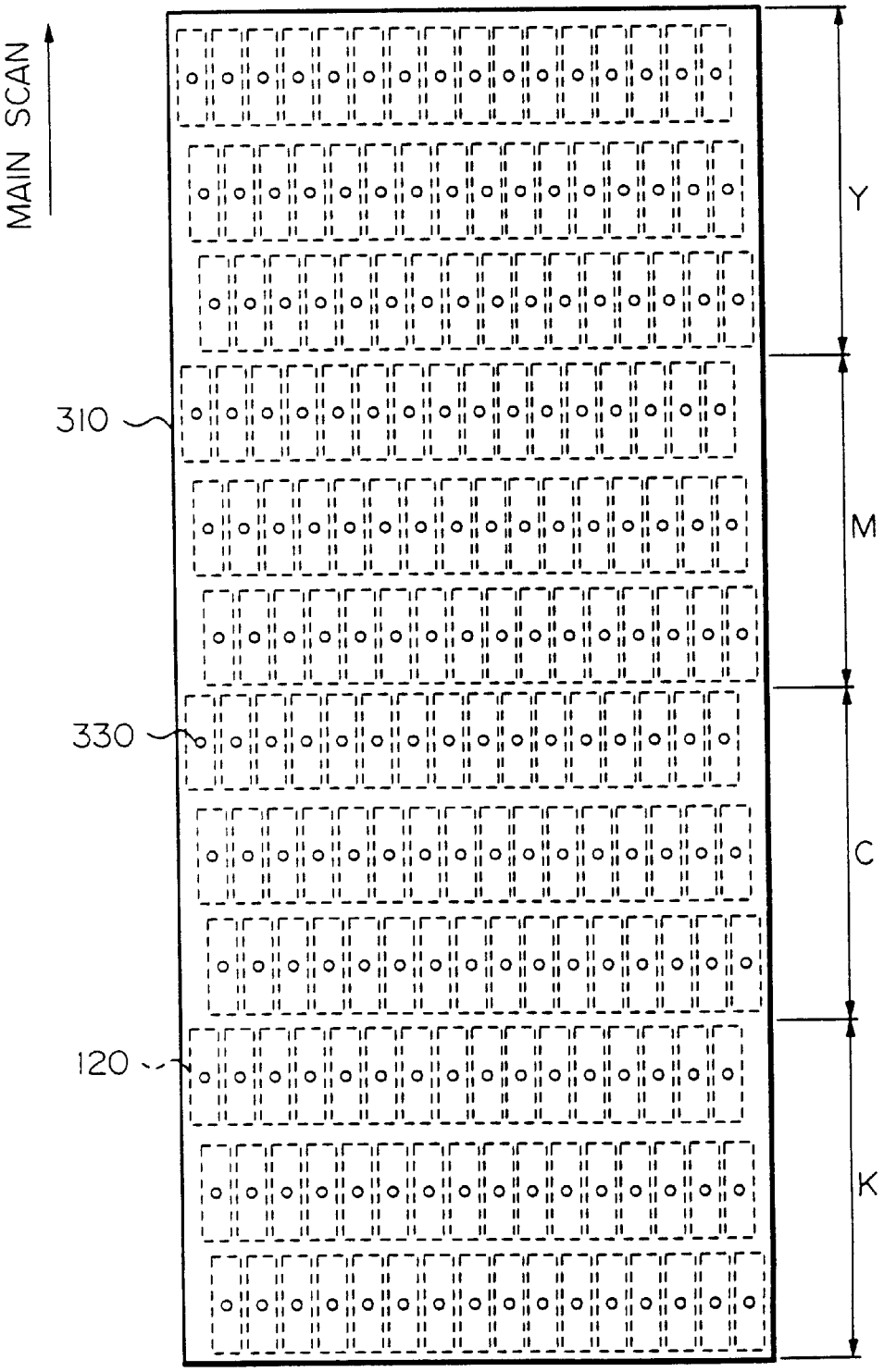
FIG. 27 is a plan view showing another specific array arrangement.

FIGS. 26A, 26B and 27 show an ink jet head in which the electrodes associated with the counter electrodes 220 or those associated with the vibration plates 120 shown in FIGS. 24 or 25 are led out to surface facing the ink ejection parts or nozzle holes. As shown in FIG. 26A the nozzles 330 are arranged in three arrays l, m and n at preselected intervals. A driver not shown, causes the head to eject ink drops in the direction of movement of a paper (main scanning direction). As shown in FIG. 26B, the ink drops ejected from the nozzle arrays l, m and n form an image on the paper in combination. Of course, the nozzles 330 may be arranged in four or more arrays in order to increase the dot density.

As shown in FIG. 27, four groups of three nozzle arrays shown in FIG. 26A may be arranged in a single chip at preselected intervals in order to implement a head for a color ink jet printer. The four chips are respectively assigned to four different colors, e.g., yellow (Y), magenta (M), cyan (C) and black (K) customary with a color ink jet printer. With such a chip, it is possible to reduce positional deviation between the colors as far as possible. Further, the arrangement of FIG. 27 reduces the mounting time, compared to the arrangement of FIG. 26A in which one chip is assigned to one color, and eliminates the need for positioning of the colors relative to each other.

In summary, it will be seen that the present invention provides an ink jet head having various unprecedented advantages, as enumerated below.

(1) Electrodes can be led out to the rear of the head without resorting to au FPC. This increases the number of nozzles available with a single water and therefore nozzle density for a single head to thereby reduce the mounting cost to a noticeable degree. Particularly, the miniature head arrangement contributes a great deal to the miniaturization of a color printer.

(2) The head can be easily connected to a printed circuit board.

(3) Bumps can be formed at any desired positions on the rear of a substrate.

(4) An ink jet head unit is made more compact when ink is fed from an ink chamber to a common chamber via passageways extending throughout a substrate.

(5) Because through holes can be easily formed, an accurate and reliable structure is achievable.

(6) A drive circuit and through holes can be formed by a rational procedure further enhancing accuracy and reliability.

(7) The through holes are tapered to facilitate the lead-out of electrodes. This, coupled with the fact that the through holes are provided with gently inclined edges and free from the disconnection of electrodes by sand blasting, allows the electrodes of an electrode substrate to be easily led out to the rear.

(8) A conductive filler filling the through holes enhances reliable electrical connection and mechanical strength.

(9) Projections formed on a part of an FPC or similar connection member additionally enhance reliable electrical connection and mechanical strength.

(10) Stepped portions formed in a part of the electrode substrate insure reliable connection even when the electrode substrate is relatively thick.

(11) Drive electrodes led out to the rear of the electrode substrate include a common portion, so that the electrode plate and a vibration plate substrate can be easily equalized in potential in a wafer size at the time of anodic bonding. This obviates defects ascribable to the deformation of vibration plates at the time of anodic bonding.

(12) When both the electrodes of the electrode substrate and the electrodes of the vibration plate substrate are led out to the rear of the electrode plate, processing and assembly in a wafer size are further facilitated.

(13) The electrodes of the electrode plate are led out to the rear of the substrate via bores or through holes formed in the substrate, so that mounting necessary for voltage application can be done at the rear of the substrate. This reduces the surface area of a chip necessary for the head and therefore cost. Moreover, easy mounting is promoted because nothing is laminated on the mounting surface.

(14) The electrodes of the electrode substrate are led out to the rear of the substrate via an impurity filled in the bores or the through holes by diffusion or implantation. Therefore, reliable conduction is set up between the front and the rear of the electrode substrate without the bores or the through holes being increased in diameter.

(15) Not only the electrodes of the electrode substrate are led out to the rear of the substrate via the bores or the through holes formed in the substrate, but also the electrodes of the vibration plate substrate are led out to the rear of the electrode substrate. This allows mounting necessary for the lead-out of the electrodes to be done in the same plane at the rear of the electrode substrate, thereby reducing the surface area of a chip necessary for the head. This, coupled with the fact that a single FPC, if it is used, suffices, reduces the cast. In addition, easy mounting is promoted because nothing is laminated on the mounting surface.

(16) The electrodes of the electrode substrate and vibration plate electrodes are led out to the rear of the substrate via an impurity filled in the bores or the through holes by diffusion or implantation. Therefore, reliable conduction is set up between the front and the rear of the electrode substrate without the bores or the through holes being increased in diameter.

(17) The electrode substrate is implemented by a (100) or (110) Si wafer. Because a (111) plane is lower in etching rate than the (100) plane and (110) plane, the bores or the through holes can be easily formed by anisotropic wet etching.

(18) The bores or the through holes each is defined by planes including at least two (111) planes low in etching rate and therefore playing the role of an etching stop plane. This promotes accurate formation of the bores or the through holes.

(19) The bores or the through holes are defined by at least two planes perpendicular to the general plane of the electrode substrate. This allows the vibration electrodes to be densely arranged.

(20) Nozzles are arranged in three or more arrays, so that a bit distance can be increased in each array. It follows that the electrode width can be increased to reduce the operation voltage while increasing the dot density. Therefore, images with high resolution are achievable.

(21) A plurality of groups of three or more nozzle arrays allow a plurality of heads for color applications to be assembled in a single chip. This reduces the mounting time, compared to a case wherein one chip is assigned to one color and makes it needless to position different colors relative to each other.

Various modifications will become possible for those skilled in the art after receiving the teachings of the present disclosure without departing from the scope thereof.

This application claims priority to Japanese Application Nos. 9-148062, 9-364174, 10-28846, 10-61308 and 10-115130 filed Jun. 5, 1997, Dec. 16, 1997, Feb. 10, 1998, Mar. 12, 1998 and Apr. 24, 1998, respectively, each of which are incorporated herein by reference.

What is claimed is:

1. An ink jet head comprising:

a vibration plate substrate including thin vibration plates; and an electrode substrate spaced from said vibration plate substrate by a small gap and carrying counter electrodes respectively facing said vibration plates on a front side thereof;

wherein when a voltage is applied between said vibration plate substrate and said electrode substrate, a resulting electrostatic force acting between any one of said vibration plates and an associated one of said counter electrodes causes ink to be ejected due to a mechanical movement of the one vibration plate, and wherein said counter electrodes on the front of said electrode substrate are led out to a rear side of said electrode substrate opposite to the front side on which said counter electrodes are provided for attachment to a controller.

2. An ink jet head as claimed in claim 1, wherein through holes are formed in said electrode substrate, and wherein said counter electrodes each is led out to the rear of said electrode substrate via an associated one of said through holes.

3. An ink jet head as claimed in claim 2, further comprising a conductor buried in said through holes, and conductor bumps formed on the rear of said electrode substrate, wherein said counter electrodes and said conductor bumps are electrically connected together via said conductor.

4. An ink jet head as claimed in claim 3, wherein said counter electrodes, said conductor and said conductor bumps are directly connected together.

5. An ink jet head as claimed in claim 4, wherein said conductor bumps and said conductor are electrically connected together by a wiring provided on a surface of said electrode substrate where said conductor bumps exist.

6. An ink jet head as claimed in claim 5, further comprising compression chambers respectively adjoining said counter electrodes for compressing the ink, a common ink chamber communicated to said compression chambers for feeding the ink, and passageways extending from said common ink chamber to the surface of said electrode substrate where said conductor bumps exist.

7. An ink jet head as claimed in claim 6, wherein recesses are formed in the rear of said electrode substrate to thereby facilitate formation of said through holes.

8. An ink jet head as claimed in claim 7, wherein after a single crystal Si substrate formed with a layer constituting said vibration plates and said electrode substrate with said counter electrodes have been bonded together, said electrode substrate is ground to a preselected thickness.

9. An ink jet head as claimed in claim 8, wherein after said electrode substrate has been ground to the preselected thickness, a drive circuit board with a drive circuit is adhered or bonded to said electrode substrate.

10. An ink jet head as claimed in claim 2, wherein said through holes each has a tapered configuration.

11. An ink jet head as claimed in claim 10, wherein a conductive filler is filled in said through holes.

12. An ink jet head as claimed in claim 11, wherein the conductive filler comprises conductive adhesive.

13. An ink jet head as claimed in claim 12, wherein stepped portions are formed in a part of the rear of said electrode substrate where said through holes exist.

14. An ink jet head as claimed in claim 13, wherein drive electrodes led out to the rear of said electrode substrate include a common portion.

15. An ink jet head a claimed in claim 2, wherein connection members connecting electrodes provided on the rear of said electrode substrate and a drive circuit for driving said vibration plates each includes a projection corresponding to any one of said through holes.

16. An ink jet head as claimed in claim 2, wherein stepped portions are formed in a part of the rear of said electrode substrate where said though holes exist.

17. An ink jet head as claimed in claim 2, wherein drive electrodes led out to the rear of said electrode substrate include a common portion.

18. An ink jet head as claimed in claim 2, wherein said through holes of said electrode plate are respectively communicated to said vibration plates, and wherein said counter electrodes on the front of said electrode substrate and said electrodes on the front of said vibration plate substrate are led out to the rear of said electrode substrate.

19. An ink jet head as claimed in claim 18, wherein a conductive filler is filled in said through holes.

20. An ink jet head as claimed in claim 19, wherein drive electrodes led out to the rear of said electrode substrate and said electrodes of said vibration substrate plate include common portions.

21. An ink jet printer as claimed in claim 1, wherein drive electrodes led out to the rear of said electrode substrate include a common portion.

22. An ink jet printer as claimed in claim 1, said counter electrodes of said electrode substrate and electrodes of said vibration plate substrate are led out to the rear of said electrode substrate.

23. An ink jet printer as claimed in claim 22, wherein drive electrodes led out to the rear of said electrode substrate and said electrodes of said vibration plate substrate include a common portion.

24. An ink jet head as claimed in claim 1, wherein said electrode substrate comprises a single crystal substance formed with either through holes or bores from at least one of a front and a rear thereof, and wherein said counter electrodes are led out to the rear of said electrode substrate via said through holes or said bores.

25. An ink jet head as claimed in claim 24, wherein an impurity is introduced into said through holes or said bores and a part of the rear of said electrode substrate by either diffusion or implantation to thereby form an impurity layer, and wherein the rear of said electrode substrate and said counter electrodes are electrically connected together via said impurity layer.

26. An ink jet head as claimed in claim 25, wherein said electrode substrate comprises a single crystal (100) or (110) Si wafer.

27. An ink jet head as claimed in claim 24, wherein electrodes provided on said vibration plate substrate are also led out to the rear of said electrode substrate via said bores or said through holes.

28. An ink jet head as claimed in claim 27, wherein an impurity is introduced into said through holes or said bores and a part of the rear of said electrode substrate by either diffusion or implantation to thereby form an impurity layer, wherein the rear of said electrode substrate and said counter electrodes are electrically connected together via said impurity layer, wherein the rear of said electrode substrate and said electrodes provided on said vibration plates are electrically connected together by said impurity layer and a conductive filler, and wherein said counter electrodes and said electrodes of sad vibration plates are insulated from each other.

29. An ink jet printer as claimed in claim 28, wherein said electrode substrate comprises a single crystal (100) or (110) Si wafer.

30. An ink jet head as claimed in claim 24, wherein said through holes or said bores are defined by planes including at least two (111) planes.

31. An ink jet head as claimed in claim 30, wherein said through holes or said bores are defined by planes including at least two planes perpendicular to a general plane of said electrode substrate.

32. An ink jet head as claimed in claim 1, wherein actuators, compression chambers and nozzles are arranged in at least three arrays.

33. An ink jet head as claimed in claim 32, wherein the at least three arrays are arranged in a zigzag configuration.

34. An ink jet head comprising:

vibration plate substrate means including thin vibration plates for causing ink to be ejected by mechanical movement of the thin vibration plates: and electrode substrate means, spaced from said vibration plate substrate means by a small gap, for carrying counter electrode member respectively facing said vibration plates on a front side thereof;

wherein when a voltage is applied between said vibration plate substrate means and said electrode substrate means, a resulting electrostatic force acting between any one of said vibration plates and an associated one of said counter electrode member causes ink to be ejected due to a mechanical movement of the one vibration plate, and wherein said counter electrode member on the front of said electrode substrate means are led out to a rear side of said electrode substrate means opposite to the front side on which said counter electrode member are provided for attachment to controller means.

* * * * *

UNITED STATES PATENT AND TRADEMARK OFFICE

CERTIFICATE OF CORRECTION

PATENT NO. : 6,332,669 B1 
DATED : December 25, 2001
INVENTOR(S) : Seiichi Kato, Kouichi Ohtaka, Hiromichi Komai and Junichi Azumi It is certified that error appears in the above-identified patent and that said Letters Patent is hereby corrected as shown below:

Title page,
Item [30] Foreign Application Priority Data,
change "Feb. 19, 1998 [JP] Japan……..10-028846" to
-- Feb. 10, 1998 [JP] Japan……..10-028846 --.

Signed and Sealed this

Fourth Day of June, 2002

*Attest:*

*Attesting Officer*

JAMES E. ROGAN
*Director of the United States Patent and Trademark Office*